US010948173B2

(12) United States Patent
Hierzer

(10) Patent No.: US 10,948,173 B2
(45) Date of Patent: Mar. 16, 2021

(54) LUMINAIRE, HOUSING COMPONENT FOR A LUMINAIRE AND METHOD FOR PRODUCING A LUMINAIRE

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 16/291,438

(22) Filed: Mar. 4, 2019

(65) Prior Publication Data

US 2019/0271461 A1 Sep. 5, 2019

(30) Foreign Application Priority Data

Mar. 2, 2018 (DE) ..... 102018001653.7

(51) Int. Cl.
*F21V 29/70* (2015.01)
*F21S 8/02* (2006.01)
(Continued)

(52) U.S. Cl.
CPC ..... *F21V 29/70* (2015.01); *F21S 8/026* (2013.01); *F21V 17/002* (2013.01);
(Continued)

(58) Field of Classification Search
CPC ..... F21S 8/02–037; F21V 17/002; F21V 19/001–007; F21V 23/00–026; F21V 29/70; F21V 29/83
(Continued)

(56) References Cited

U.S. PATENT DOCUMENTS 7,631,985 B1 12/2009 Knoble et al.
8,007,127 B2 * 8/2011 Kim ..... G02B 19/0028 362/245
(Continued)

FOREIGN PATENT DOCUMENTS

DE 202011000426 U1 5/2011
DE 202011000426 U1 6/2011
(Continued)

OTHER PUBLICATIONS

Office Action in corresponding DE10 2018 001 653.7 dated Jul. 9, 2020 (pp. 1-4).
(Continued)

*Primary Examiner* — Jason M Han
(74) *Attorney, Agent, or Firm* — Millen, White, Zelano & Branigan, P.C.; William Nixon

(57) ABSTRACT

The present disclosure relates to a luminaire including a housing component and at least one LED carrier circuit board. The housing component has at least one section which projects from a base of the housing component and which is formed with a plurality of surfaces oriented differently relative to the base. The LED carrier circuit board carries at least one LED device as light source for providing light to be emitted by the luminaire. The LED carrier circuit board is arranged by a rear side thereof at least in sections on one of the plurality of surfaces of the section projecting from the base in such a way that the LED device overlies the surface at least partially. The housing component, in the region of the base thereof, has at least one region which is formed as a heatsink for dissipating heat generated by the LED device during operation.

29 Claims, 10 Drawing Sheets

(51) Int. Cl.

| | |
|---|---|
| ***F21V 19/00*** | (2006.01) |
| ***F21V 23/00*** | (2015.01) |
| ***F21V 23/02*** | (2006.01) |
| ***F21V 17/00*** | (2006.01) |
| ***F21V 29/83*** | (2015.01) |
| ***F21Y 115/10*** | (2016.01) |

(52) U.S. Cl.
CPC ..... *F21V 19/003* (2013.01); *F21V 19/0035* (2013.01); *F21V 23/003* (2013.01); *F21V 23/02* (2013.01); *F21V 29/83* (2015.01); *F21Y 2115/10* (2016.08)

(58) Field of Classification Search
USPC ..... 362/249.02, 294
See application file for complete search history.

(56) References Cited

U.S. PATENT DOCUMENTS

| | | | |
|---|---|---|---|
| 9,683,726 | B2 | 6/2017 | Seki |
| 2007/0098334 | A1 | 5/2007 | Chen |
| 2009/0154160 | A1 | 6/2009 | Li et al. |
| 2013/0039064 | A1 | 2/2013 | Lui |
| 2016/0076743 | A1* | 3/2016 | Deutsch ..... F21V 7/0091 362/268 |
| 2017/0167665 | A1 | 6/2017 | Germain et al. |
| 2017/0175987 | A1 | 6/2017 | Newton et al. |
| 2018/0058676 | A1 | 3/2018 | Huang et al. |

FOREIGN PATENT DOCUMENTS

| | | | |
|---|---|---|---|
| DE | 202014102004 | U1 | 7/2015 |
| DE | 202014102004 | U1 | 9/2015 |
| DE | 202014105429 | U1 | 2/2016 |
| DE | 202014105429 | U1 | 3/2016 |
| WO | 13153758 | A1 | 10/2013 |

OTHER PUBLICATIONS

Search report in corresponding EP 19160429 dated May 17, 2019 (pp. 1-9) (dated May 31, 2019).
Office Action for related German Application No. 102018001653.7 dated Nov. 26, 2018.
English Translation for DE-202011000426, Publication Date: May 12, 2011.
English Abstract for DE-202014105429, Publication Date: Feb. 15, 2016.
English Abstract for DE-202014102004, Publication Date: Jul. 31, 2015.
Office Action/ Examination report in corresponding EP application 19160429.7 dated May 7, 2020 (pp. 1-4).

* cited by examiner (B - B)

(A - A)

LUMINAIRE, HOUSING COMPONENT FOR A LUMINAIRE AND METHOD FOR PRODUCING A LUMINAIRE

FIELD OF THE INVENTION

The invention relates to a luminaire, a housing component for a luminaire, and a method for producing a luminaire.

TECHNICAL BACKGROUND

The applicant is aware of luminaires which comprise for example individual luminous points or light sources arranged linearly in a row and act as "downlight" or as "wallwasher". Furthermore, the applicant is aware of luminaires in which individual light sources of this type are provided in a matrixlike fashion.

However, conventional luminaires of the type mentioned above are limited with regard to their configurability. A light scene or lighting effect sought often requires the use of a plurality of luminaires.

SUMMARY OF THE INVENTION

One of the ideas of the invention is to specify a luminaire which can be configured beforehand for a wide variety of lighting effects or light scenes and then be assembled, which furthermore is constructed compactly and can nevertheless achieve in particular a multiplicity of lighting effects, which despite its compact construction makes it possible to effectively dissipate quantities of heat that arise, and which in addition is producible economically.

Accordingly, a luminaire is proposed which comprises a housing component and at least one LED carrier circuit board. The housing component has at least one section which projects from a base of the housing component and which is formed with a plurality of surfaces oriented differently relative to the base. The LED carrier circuit board carries at least one LED device as light source for providing light to be emitted by the luminaire. In the case of the luminaire according to the invention, the LED carrier circuit board is arranged by a rear side thereof at least in sections on one of the plurality of surfaces of the section projecting from the base in such a way that the LED device overlies said one of the surfaces at least regionally/partially. Furthermore, in the case of the luminaire according to the invention, the housing component, in the region of the base thereof, has at least one region which is formed as a heatsink for dissipating heat generated by the LED device during operation.

Furthermore, a housing component for a luminaire, in particular for a luminaire of this type, is proposed, wherein the housing component has at least one, in particular domelike, section which projects from a base of the housing component and which is connected to the base in a self-supporting manner and is formed with a plurality of surfaces oriented differently relative to the base. In the region of the base of the housing component, the housing component has at least one region formed as a heatsink. The housing component is furthermore configured for securing at least one LED carrier circuit board carrying at least one LED device as light source for providing light to be emitted by the luminaire to the housing component in such a way that heat generated by the LED device during operation is able to be dissipated via the section projecting from the base into the region formed as a heatsink.

Furthermore, the invention proposes a method for producing a luminaire, in particular a luminaire of this type, wherein the method comprises the following steps:

- Providing a housing component having a predefined number of function fields, wherein the housing component has a plurality of sections which project from a base of the housing component and which are formed in particular in an identical way and are formed in each with a plurality of surfaces oriented differently relative to the base, wherein one of the plurality of sections projecting from the base is arranged in each of the function fields;
- Equipping the housing component with one LED carrier circuit board or a plurality of LED carrier circuit boards and/or with one assembly or a plurality of assemblies, each comprising at least one LED carrier circuit board and at least one optical component, in such a way that the LED carrier circuit board or a plurality of the LED carrier circuit boards is or are arranged in each case by a rear side thereof at least in sections on one of the plurality of surfaces of an assigned one of the sections projecting from the base in such a way that an LED device provided on the LED carrier circuit board overlies said one of the surfaces at least regionally/partially.

One of the concepts underlying the present disclosure consists in proposing a luminaire whose construction follows a modular system approach. The luminaire according to the invention, even before it has been assembled, in other words before the assembly of the individual parts of the luminaire, can be configured and thereby individually shaped and fashioned in a flexible manner. A high degree of modularity and flexibility is thus afforded. The modular, configurable construction of the luminaire is made possible by the housing component of the luminaire that is provided according to the invention, the projecting section of which housing component is formed with the surfaces oriented differently relative to the base. In this way it becomes possible, for example, to use the LED carrier circuit board in such a way that light can optionally be emitted for instance in accordance with the emission characteristic of a downlight or of a wallwasher, for example with the aid of optical components provided therefor. For a given size of the luminaire, just a single shaping of the housing component thus becomes necessary. One and the same type of housing component thus makes possible differently configured luminaires and thus many kinds of lighting effects. Depending on the desired effect that is intended to be achieved with the LED device, and depending on the desired main emission direction, for instance in the manner of a downlight or wallwasher, the LED carrier circuit board can be positioned by its rear side on one of the differently oriented surfaces of the section projecting from the base. With one and the same housing component, a wider variety of arrangements of the LED carrier circuit board are implemented in conjunction with a compact and cost-saving construction of the luminaire, in association with effective heat dissipation via the section projecting from the base and the region formed as a heatsink, and thus in association with effective cooling of the LED device. The configuration of the luminaire can be carried out even before production and delivery thereof, for instance during ordering, for example by the customer or light designer. The multifunctional housing component combines in itself a housing function and also, with the region acting as a heatsink, a cooling function in one and the same component. This, too, contributes to a compact luminaire. In particular, the luminaire can be made comparatively small in a space-saving fashion and nevertheless illuminate a large spatial region.

The situation in which the LED device at least regionally/partially overlies the surface of the section projecting from the base is intended to be understood in the present application so as also to encompass cases in which between the LED device and the surface overlying there is/are also one/a plurality of further component(s), in particular a partial region of the LED carrier circuit board on which the LED device is arranged. The overlying mentioned above can be understood in this sense to the effect that the LED device covers at least regionally said surface of the section projecting from the base, although one or a plurality of further components, in particular said partial region of the LED carrier circuit board, can be arranged between the LED device and the surface. Arrangements in which the LED device is situated completely within the boundaries of said surface or the surface is completely overlain by the LED device are also intended to be encompassed, in particular.

Advantageous embodiments and developments are evident from the dependent claims and also from the description with reference to the figures of the drawing.

In one embodiment, the housing component is integrally cast, in particular integrally die-cast. A housing component of this type can be produced economically even with relatively complex shaping.

In one preferred embodiment, the housing component is formed with a metal material. In particular, the housing component can be produced from a metal material by die-casting, for example. The metal material can be aluminium or an aluminium alloy, for example. A housing component of this type is well suited to acting regionally as a heatsink, and is additionally robust.

In one embodiment, a basic area of the housing component is formed in particular in a rectangular or square fashion. This can be useful in many mounting situations. Other shapes are likewise conceivable, however.

Preferably, the section projecting from the base is formed such that it is connected to the base in a self-supporting manner. This enables good access to the projecting section.

In one configuration, the section projecting from the base of the housing component is formed in a domelike fashion. The outer shape of the section projecting from the base preferably has the shape of a truncated pyramid. Sufficiently large and suitably oriented surfaces, for example including oblique surfaces relative to the base, can be provided in this way.

In one embodiment, the shape of the truncated pyramid is formed as a shape of a frustum of a regular pyramid, in particular of a right pyramid having a square base area. Other base area shapes are also conceivable, however, in particular base areas in the shape of a regular polygon. Such shapes have advantageous symmetries.

In particular, the outer shape of the section projecting from the base can have a rotational symmetry and can be mapped onto itself for example by rotation about an axis by a defined angle. For example, it can be provided that the outer shape of the section projecting from the base can be mapped onto itself upon rotation about an axis by 90 degrees, which is the case for example for the abovementioned shape of a frustum of a regular pyramid having a square base area. This simplifies the arrangement of the LED carrier circuit board in sections by the rear side thereof optionally on different surfaces from among the surfaces of the section projecting from the base.

In one embodiment, a surface of the surfaces of the section projecting from the base forms a top surface thereof and is oriented preferably substantially parallel to a main extension plane of the base. In this embodiment, further surfaces from among the surfaces of the section projecting from the base are formed as surfaces inclined with respect to the main extension plane of the base.

In particular, the LED carrier circuit board is arranged at least by a section of the rear side thereof on said one of the plurality of surfaces of the section projecting from the base in such a way that the LED device overlies said one of the surfaces at least regionally/partially.

By way of example, for an LED device which provides light which is intended to be emitted by the luminaire in the manner of a downlight, the rear side of the LED carrier circuit board can be arranged in sections on the top surface of the section projecting from the base. By contrast, for an LED device which provides light which is intended to be emitted by the luminaire in the manner of a wallwasher, the rear side of the LED carrier circuit board can be arranged in sections on one of the inclined surfaces of the section projecting from the base. The different inclined surfaces can afford the possibility, in particular, of selecting the emission direction, without a modified housing component being required.

The surfaces of the projecting section which are oriented differently relative to the base can be planar surfaces, in particular. This further facilitates the arrangement of the LED carrier circuit board on one of said surfaces.

In one embodiment, the luminaire comprises at least one adapter component provided with a cutout, in which the section projecting from the base is able to be accommodated at least regionally. In this case, an LED carrier circuit board is secured on the adapter component in such a way that the LED carrier circuit board secured to the adapter component placed onto the section projecting from the base is arranged by a rear side of said LED carrier circuit board on one of the inclined surfaces of the section projecting from the base at least in sections in such a way that the LED device arranged on said LED carrier circuit board overlies said one of the inclined surfaces at least regionally. This embodiment makes it possible to achieve a defined, stable arrangement of the LED carrier circuit boards in sections by the rear side thereof on one of the inclined surfaces and reliable securing of the LED carrier circuit board in the housing component.

In one development, the adapter component is integrally cast, in particular integrally die-cast. An adapter component of this type can be produced economically.

In particular, the adapter component is formed with a metal material. The adapter component can be manufactured from a metal material like the housing component, for example by die-casting. The metal material can be aluminium or an aluminium alloy, for example. Such materials have good heat conducting properties for the adapter component and contribute to a robust adapter component.

In one embodiment, inclinations of mutually opposite surfaces of the cutout of the adapter component correspond to the inclinations of two of the inclined surfaces of the section projecting from the base. Furthermore, in one development, an inclination of an accommodating surface of the adapter component for accommodating the LED carrier circuit board can correspond to the inclination of one of the further inclined surfaces of the section projecting from the base. Consequently, an areal contact makes it possible to achieve, in particular, stable securing of the adapter component on the projecting section and good heat dissipation.

In one preferred embodiment, the housing component has a plurality of the sections projecting from the base, which are formed in an identical way. Furthermore, in this case, the luminaire comprises a plurality of function fields, wherein one of the plurality of sections projecting from the base is arranged in each of the function fields. In particular, the section projecting from the base can be arranged in each case substantially in the centre of the function field. This makes possible a multiplicity of different ways of arranging LED devices such that effective heat dissipation becomes possible in a compact and expedient manner.

The plurality of sections projecting from the base and thus also the function fields can be arranged along a line or in accordance with a two-dimensional pattern or grid. By way of example, the projecting sections and thus the function fields can be arranged linearly in a row or instead in a matrixlike fashion. This can further facilitate the arrangement of the LED devices and of the LED carrier circuit board(s) and extend the combination possibilities. A luminaire of this type can moreover be designed in an aesthetically attractive fashion.

In one embodiment, provision can be made for the luminaire to comprise only a single function field. In preferred embodiments, provision can be made for the luminaire to comprise a plurality of function fields, for example two, three, four, five or six function fields, or a different number thereof, arranged in a row next to one another and thus "linearly". In further preferred embodiments, the function fields can be arranged in accordance with an n×m matrix having n rows and m columns, for example a 2×2 matrix or a 3×3 matrix or a 3×2 matrix. Here n, m are integers in each case.

In one preferred embodiment, the function fields can be of square shape. Other shapes, for example rectangular function fields, are likewise conceivable. Square function fields, in particular, can be easily arranged regularly and in a space-saving manner.

In one embodiment, the housing component, in the region of the base thereof, has for each function field a region which is assigned to said function field and which is formed as a heatsink for dissipating heat that is generatable by an LED device arrangeable in said function field during the operation of said LED device. Consequently, the heat generated by each of the LED devices can be dissipated effectively and reliably, which can have a favourable effect for example on the lifetime of the LED devices.

In one embodiment, the plurality of regions formed as heatsinks are spaced apart from one another by channels on a rear side of the base facing away from the sections projecting from the base. This further improves the cooling effect of said regions. The channels can further improve the heat dissipation by convection, for example.

In one embodiment, the luminaire comprises a plurality of LED devices, each of which is assigned to one of the function fields and is arranged in said one of the function fields. Consequently, the luminaire comprises a plurality of light sources, which is advantageous for generating different light effects or illuminating different regions.

In one embodiment, the luminaire comprises a plurality of LED carrier circuit boards, wherein each of the LED carrier circuit boards carries one or a plurality of the LED devices. Carrier circuit boards which each carry one LED device can easily be combined with one another and with other LED carrier circuit boards. By arranging a plurality of LED devices on an LED carrier circuit board, it is possible to simplify the assembly of the luminaire. In one embodiment, all of the LED devices can be carried by the same LED carrier circuit board.

In a further exemplary embodiment, a plurality of LED devices, each of which is assigned to one of a plurality of the function fields, are arranged on one LED carrier circuit board. In this way, for example, LED devices oriented in the same way can be provided and incorporated into the luminaire in a simple way.

In a further embodiment, a plurality of LED carrier circuit boards can be provided, each carrying one of a plurality of LED devices, wherein each of the LED devices is assigned to one of the function fields. In this way, the function fields can readily be equipped with LED devices in a different way, for example with differently oriented LED devices.

In one embodiment, the plurality of LED carrier circuit boards are formed differently from one another. In particular, the LED carrier circuit boards can carry different numbers of LED devices, as a result of which, for example, one/a plurality of LED carrier circuit board(s) each having a single LED device is/are combinable with one/a plurality of LED carrier circuit board(s) each having a plurality of LED devices. The housing component makes it possible to combine different LED carrier circuit boards in a luminaire in order to realize different function fields and lighting effects. In particular, different circuit board shapes can be combined in a luminaire, as a result of which, for example, a sought arrangement of LED devices for the configuration of the luminaire becomes possible in the simplest and most economic way possible.

In one embodiment, the luminaire comprises one optical component or a plurality of optical components. Here the optical component(s) is/are arranged in each case in particular in one of the function fields. By way of example, the optical component(s) is/are arranged in such a way that a function field has a predefined emission characteristic, for example the emission characteristic of a downlight or of a wallwasher, by means of the interaction of the optical component with the LED device. If a plurality of optical components are provided, then each of the optical components of the luminaire in interaction with the LED device assigned to the optical component brings about a respectively predefined emission characteristic of the respective function field. The emission characteristics of different function fields can differ from one another for generating different light effects and can be formed for example in each case as an emission characteristic of a downlight or wallwasher. A combination of different emission characteristics in one luminaire thus becomes possible in an economic way. With the aid of the advantageous design of the housing component, each of the function fields can be equipped with the emission characteristic of a downlight or of a wallwasher in a selectable manner.

In particular, the rear side of the LED carrier circuit board for a function field having the emission characteristic of a downlight can be arranged in sections on the top surface of the section projecting from the base. By contrast, the rear side of the LED carrier circuit board for a function field having the emission characteristic of a wallwasher can be arranged in sections on one of the inclined surfaces of the section projecting from the base.

The optical component can have for example in each case a rectangular or preferably square outer contour, in particular in such a way that a plurality of the optical components can be arranged next to one another in a manner substantially filling a rectangular or square region.

In one embodiment, the optical component(s) is/are formed in each case as a reflector. An embodiment of the optical component(s) as lens(es) would likewise be conceivable, however. A combination of reflector(s) and lens(es) is also conceivable.

In one embodiment, in at least one first of the function fields a first LED carrier circuit board is arranged by a rear side thereof at least in sections on a first surface of that section projecting from the base which is assigned to the first function field in such a way that an LED device assigned to the first function field and carried by the first LED carrier circuit board overlies the first surface at least regionally. In this case, furthermore a first optical component is arranged in the first function field, and imparts a first emission characteristic to the first function field. Furthermore, in this embodiment, in at least one second of the function fields a second LED carrier circuit board is arranged by a rear side thereof at least in sections on a second surface of that section projecting from the base which is assigned to the second function field in such a way that an LED device assigned to the second function field and carried by the second LED carrier circuit board overlies the second surface at least regionally. In this case, a second optical component is arranged in the second function field, and imparts a second emission characteristic to the second function field. In this case, the first surface and the second surface are oriented in the same way relative to the base. In this embodiment, the first and second emission characteristics are substantially identical or different from one another. Consequently, two function fields are provided, which, by means of a respective optical component, can emit light having a predefined emission characteristic for example in the same main direction. In particular, in one development, the first and second emission characteristics can be formed in each case as an emission characteristic of a downlight or in each case as an emission characteristic of a wallwasher. Consequently, the first and second function fields can emit for example in each case in the manner of a downlight or in each case in the manner of a wallwasher.

In one embodiment, at least one first of the function fields a first LED carrier circuit board is arranged by a rear side thereof at least in sections on a first surface of that section projecting from the base which is assigned to the first function field in such a way that an LED device assigned to the first function field and carried by the first LED carrier circuit board overlies the first surface at least regionally. In this case, furthermore a first optical component is arranged in the first function field, and imparts a first emission characteristic to the first function field. Furthermore, in this configuration, in at least one second of the function fields a second LED carrier circuit board is arranged by a rear side thereof at least in sections on a surface surface of that section projecting from the base which is assigned to the second function field in such a way that an LED device assigned to the second function field and carried by the second LED carrier circuit board overlies the second surface at least regionally. In the case, a second optical component is arranged in the second function field, and imparts a second emission characteristic to the second function field. The second surface is oriented differently from the first surface relative to the base. In this case, in particular, in one development, the first and second emission characteristics can be formed in each case as an emission characteristic of a wallwasher. In an alternative development, the first emission characteristic can be formed as an emission characteristic of a downlight and the second emission characteristic can be formed as an emission characteristic of a wallwasher.

In one embodiment, a sensor device is arranged in at least one of the function fields. Consequently, the functional scope of the luminaire can be extended by an additional function in a space- and outlay-saving manner.

In further embodiments, the sensor device could be formed for example as a presence sensor or as a brightness sensor or as a moisture sensor or as a temperature sensor. Sensor devices for detecting other parameters are likewise conceivable, however.

In one embodiment, the luminaire comprises a connection unit or a connection and control unit equipped with a plurality of connecting devices, by means of which the LED carrier circuit board or a plurality of the LED carrier circuit boards is/are able in each case to be electrically coupled to the connection unit or the connection and control unit. In this embodiment, the housing component is formed in a trough-like fashion with a bottom formed by the base, side walls, an inner region and an open side. The housing component has in a side wall a recess also extending into the base and serving for accommodating the connection unit or the connection and control unit, wherein the connection unit or the connection and control unit is formed in a flat fashion and is accommodated with its main extension plane along the side wall in sections in the inner region of the housing component and in the recess. Such a connection unit or connection and control unit can be accommodated in a space-saving manner and enables a diverse, flexible coupling to the carrier circuit boards.

In particular, the connection unit can be arranged substantially flush with an outer side of the housing component. In this way the connection unit is arranged in a particularly space-saving manner.

In one embodiment, the luminaire comprises a central control arrangement, which provides a plurality of channels for controlling the LED device or a plurality of the LED devices. In this case, in particular by means of the control arrangement a plurality of the LED devices are driveable in each case individually and/or in a manner combined in groups. This enables highly flexible switching and/or control of the LED device(s). It is thus possible to provide a uniform luminaire having a plurality of light sources which are switchable and/or controllable for generating different light effects.

In one embodiment, each of the LED devices can be driven separately by the central control unit via one or two control channel(s) assigned to the LED device.

In particular, the central control arrangement can provide at least one control channel or at least two control channels per LED device. With at least one control channel for each LED device, each of the latter can be controlled separately in terms of the light intensity thereof. At least two control channels per LED device make possible, moreover, a colour variation of the emitted light, for example with the aim of "tunable white".

In developments of the invention, a plurality of the LED devices can be driven via one or two common control channels.

In one embodiment, the luminaire is switchable and/or drivable by means of a switching and/or control signal provided in a wireless or wired manner, in particular for switching and/or controlling the LED device(s) or groups thereof. The luminaire can comprise an interface for receiving such a switching and/or control signal in a wireless or wired way. Preferably, the luminaire is wirelessly switchable and/or driveable and comprises a corresponding interface.

In one development, the central control unit can be configured to receive a switching and/or control signal for switching and/or controlling the LED device(s) or groups of the LED devices in a wireless and/or wired way, for example by means of a ZigBee interface or a DALI interface.

In one embodiment, a power electronic component and/or power electronic arrangement are/is arranged together with the LED device on the LED carrier circuit board. Alternatively or additionally, the power electronic component and/or power electronic arrangement can be provided on a further circuit board arranged at least partly within the function field assigned to the LED device. The further circuit board can be arranged in particular at least in sections on one of the plurality of differently oriented surfaces of the section projecting from the base, for example on one of the inclined surfaces. Power electronic elements can thus be provided in a manner decoupled from the central control arrangement.

In one embodiment, the LED device(s) is/are dimmable in an analogue manner. In the present application, analogue dimming should be understood to mean in particular current dimming which makes possible, by regulation of a constant current with which the LED device(s) is/are supplied in each case for the operation thereof, a dimming of the light emission by the LED device and thus in particular a dimming of the light emitted by the assigned function field mentioned above. A dimming of this type thus differs from a pulse dimming, in which the dimming is achieved by periodically switching the light source on/off ("pulse").

The LED device(s) has/have in each case in particular at least one LED. The LED device(s) can be formed in each case in particular as one LED (light-emitting diode) or as a group of a plurality of LEDs.

In one embodiment, the luminaire is configured for supplying the LED device or LED devices of the luminaire with electrical energy by means of an external converter. This makes it possible to provide a luminaire that is simplified with regard to the driving and supply of the LED device(s), while at the same time saving costs. In this embodiment, it is possible to dispense with power electronic components on the LED carrier circuit board(s) and/or the further circuit board(s).

In one embodiment, the luminaire comprises an installation frame, with which the housing component is latchable by means of spring-loaded elements, in particular spring-loaded balls, arranged on the housing component. For this purpose, the housing component can be inserted into the installation frame, wherein the installation frame has an inner region which corresponds to the housing component and which serves for accommodating the housing component. By means of the spring-loaded balls that latch in the installation frame in particular in a releasable manner, the housing component can be secured and held in the installation frame reliably and in a simple manner. The housing component can be released from the installation frame in a simple manner as necessary.

In a further embodiment, the installation frame is formed in such a way that the housing component is introducible into the inner region of the installation frame from two sides thereof and is latchable with the installation frame. The frame is usable in two installation positions in this way. By way of example, the installation frame can be configured to be installed in a first position in such a way that a first edge of the installation frame remains visible from a viewing side after installation, and to be installed in a second position in such a way that a second edge of the installation frame is no longer visible from the viewing side, for example as a result of filler being applied. It is thus possible to comply with different installation situations in a flexible manner.

In one embodiment of the method, the housing component is provided and equipped depending on configuration data specified by the customer when ordering the luminaire before the production thereof. For the customer this affords the advantage of being able to select, from a multiplicity of possible configurations, an exactly matching luminaire configuration that provides the desired effects. During the production of the luminaire, it is possible, in a cost-saving manner, to have recourse to a uniform housing component for any luminaire size, that is to say for any number and geometric arrangement of function fields. The housing component can be used in the same way for luminaires of widely varying configuration, without rework being necessary.

In a further configuration of the method, depending on the configuration data specified when ordering the luminaire, a program executable by means of a data processing device of a control arrangement of the luminaire is transferred to a storage medium of the control arrangement. The luminaire, upon the delivery thereof, is thus adapted to the selected configuration of the function fields on the control side as well.

In one embodiment of the method, equipping can comprise equipping the housing component with at least one LED carrier circuit board and an optical component assigned thereto successively.

It goes without saying that the above embodiments and developments of the invention can analogously find applications to the luminaire according to the invention and also to the housing component according to the invention and to the method of the invention.

The above embodiments and developments can be combined with one another, if practical, in any desired way. Further possible embodiments, developments and implementations of the invention also encompass not explicitly mentioned combinations of features of the invention described above or below with regard to the exemplary embodiments. In particular, in this case the person skilled in the art will also add individual aspects as improvements or supplementations to the respective basic form of the present invention.

BRIEF DESCRIPTION OF THE DRAWINGS

The present invention is explained in greater detail below on the basis of the exemplary embodiments indicated in the schematic figures of the drawings, in which.

The accompanying drawings are intended to convey a further understanding of the embodiments of the invention. They illustrate embodiments and, in association with the description, serve to explain principles and concepts of the invention. Other embodiments and many of the advantages mentioned become apparent in view of the drawings. The elements of the drawings are not necessarily shown in a manner true to scale with respect to one another.

In the figures of the drawings, identical, functionally identical and identically acting elements, features and components are provided in each case with the same reference signs—unless explained otherwise.

DESCRIPTION OF EXEMPLARY EMBODIMENTS

FIGS. 1 to 15 illustrate a luminaire 1 in accordance with one exemplary embodiment. The luminaire 1 can for example be installed in a suspended ceiling, for example, or be secured to a ceiling, wherein fitting to other parts of a building, for instance in the wall region, is likewise possible. The luminaire 1, before its production and delivery, is freely configurable by the customer, for example by a light designer, for example in order to unite a plurality of light effects to be presented by means of the luminaire 1 in the luminaire 1 in the desired way.

Figure 1:
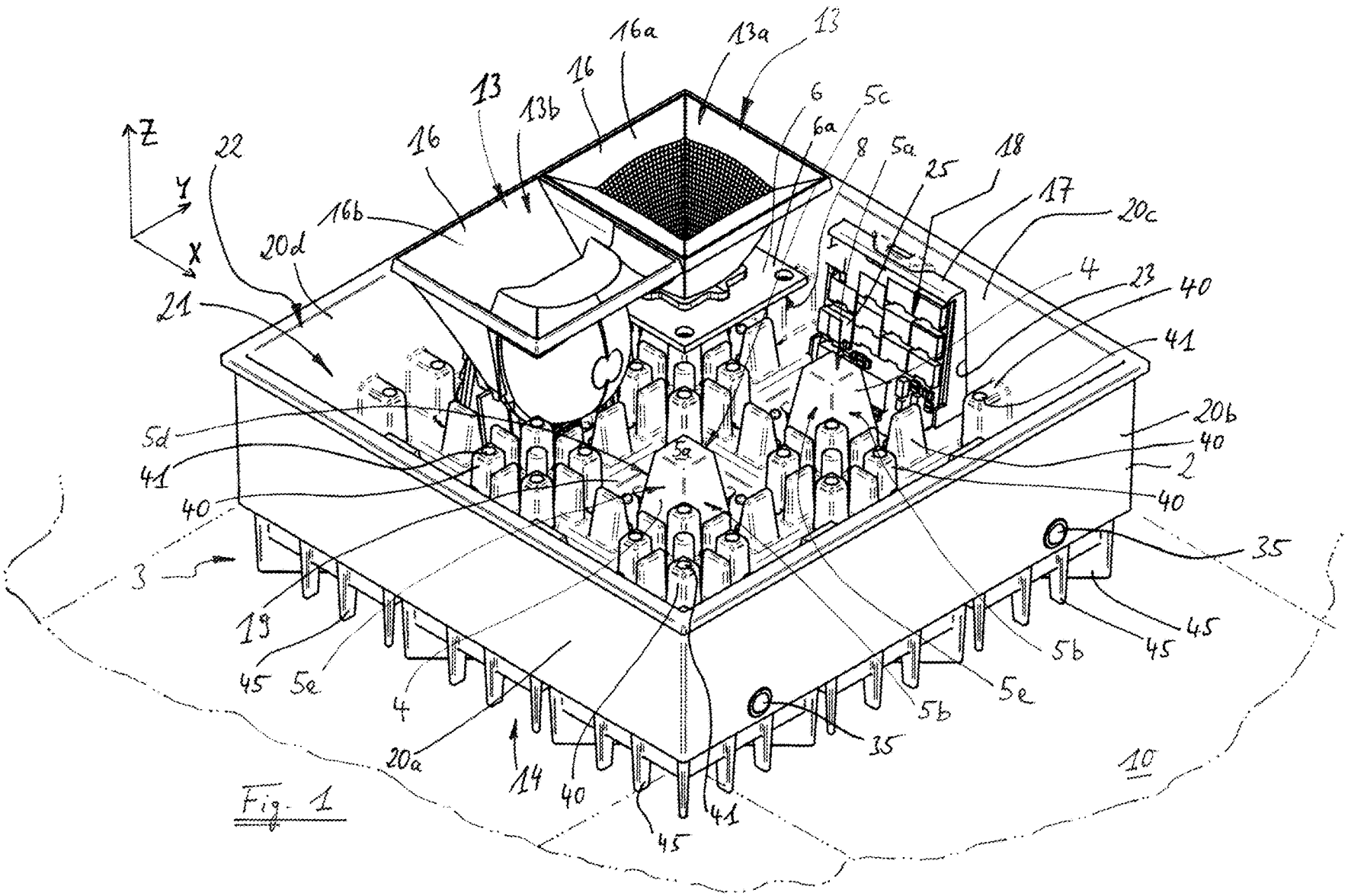
FIG. 1 shows a partly equipped housing component of a luminaire in accordance with one exemplary embodiment in a perspective bottom view.

The housing component 2 in FIG. 1 is integrally die-cast from a metal material, for example aluminum or aluminum alloy, wherein the housing component 2 has a substantially square basic area in the exemplary embodiment illustrated in FIG. 1. A height of the housing component 2, in comparison with the edge length of the square basic area thereof, is significantly smaller than said edge length, as a result of which the housing component 2, with regard to its outer shape, has the basic shape of a flat parallelepiped.

The housing component 2 has a base 3, the main extension plane 10 of which is indicated schematically in FIG. 1. In the main extension plane 10, the housing component 2 has the substantially square basic area mentioned above. The main extension plane 10 is substantially parallel to a plane spanned by the directions X and Y in FIG. 1.

The housing component 2 is formed in a troughlike fashion, wherein the base 3 forms a bottom 19 of the housing component 2 and the housing component 2 furthermore has side walls 20*a* to 20*d*, which are formed in a manner extending around the housing component 2 and connected to one another and, in the circumferential direction of the housing component 2, delimit an inner region 21 thereof. The housing component 2 has an open side 22 at the top in FIG. 1.

A multiplicity of projectionlike sections 40 and 4 protrude from the base 3 in the inner region 21 upward in FIG. 1. The sections 4 projecting from the base 3 are formed such they are larger than the further sections 40. The function of the sections 4 is explained in even greater detail below. The projectionlike sections 40 projecting into the inner region 21 are formed in various ways, but a multiplicity of the sections 40 end at the same height relative to the base 3 in a direction Z normal to the main extension plane 10 and are each equipped with a securing opening 41, the function of which will likewise be explained below. In FIG. 1, for the sake of better clarity, only some of the sections 40 and securing openings 41 are provided with reference signs. All of the sections 40, 4 are formed integrally with the housing component 2. Many of the sections 40, and all of the projecting sections 4, are integrally connected to the base 3 in a self-supporting manner, see FIG. 1.

Each of the sections 4 or "domes" projecting from the base 3 is formed in a domelike fashion, see FIGS. 1, 7, 9 and 10, wherein, in the example shown, the outer shape of the section 4 corresponds in each case to the shape of a frustum of a right pyramid having a square base area. In this way, the section 4 has in each case a rotational or circular symmetry about a centre axis of the section 4 that is parallel to the direction Z, as a result of which the section 4 can be mapped onto itself in each case by a rotation by 90 degrees about the centre axis.

Each of the sections 4 projecting from the base 3 is formed in an identical way to the other sections 4 and has on its outer side a plurality of planar surfaces 5*a* to 5*e* oriented differently relative to the base 3. In this case, the surface 5*a* forms a top surface of the section 4, which top surface is substantially parallel to the plane spanned by the directions X and Y, and thus to the main extension plane 10, and is likewise substantially square, whereas the further surfaces 5*b*, 5*c*, 5*d* and 5*e* are inclined with respect to the main extension plane 10 and jointly form a lateral surface of the truncated pyramid shape, see also FIGS. 9 and 10. The section 4 is thus flattened at its top side facing away from the base 3.

Each of the sections 4 projecting from the base 3 is assigned to a function field 13 of the luminaire 1 and is arranged centrally within the function field 13. In the exemplary embodiment in FIGS. 1 to 15, the luminaire 1 comprises a total of nine function fields 13, which are identified schematically by dotted lines and clearly discernibly for example in FIG. 5. In this exemplary embodiment, the function fields 13 are arranged in a matrixlike fashion in accordance with a 3×3 matrix, wherein all the function fields 13 are of the same size and square in each case.

Consequently, one surface 5*a* parallel to the main extension 10 and a plurality of surfaces 5*b*-5*e* inclined at the same inclination with respect to the main extension plane 10 are provided in each of the function fields 13.

The base 3 of the housing component 2 has, for each function field 13, a region 9 assigned thereto, said region being formed as a heatsink. See FIGS. 1, 3, 4, 6, and 8, for example. For the purpose of better heat dissipation, each region 9 is equipped with a plurality of cooling ribs 45, which are visible in particular in FIG. 8. Furthermore, the regions 9, formed integrally with the housing component 2 as partial regions thereof, are arranged on a rear side 14 of the base 3 facing away from the projecting sections 4, 40 and thus also from the inner region 21. The regions 9 are spaced apart from one another on the rear side 14 by channels 15, which form a lattice pattern in the example shown, see FIG. 4. The channels 15 serve to further improve the cooling effect of the regions 9. In the channels 15 formed as air channels, it is possible to achieve an effective air flow which, in combination with the large outer surface area ratio of each heatsink region 9, contributes to effective heat dissipation. In the exemplary embodiment illustrated, in which there may be a high demand for effective heat dissipation on account of the plurality of LED devices 7, optimized thermal management thus advantageously becomes possible.

Figure 2:
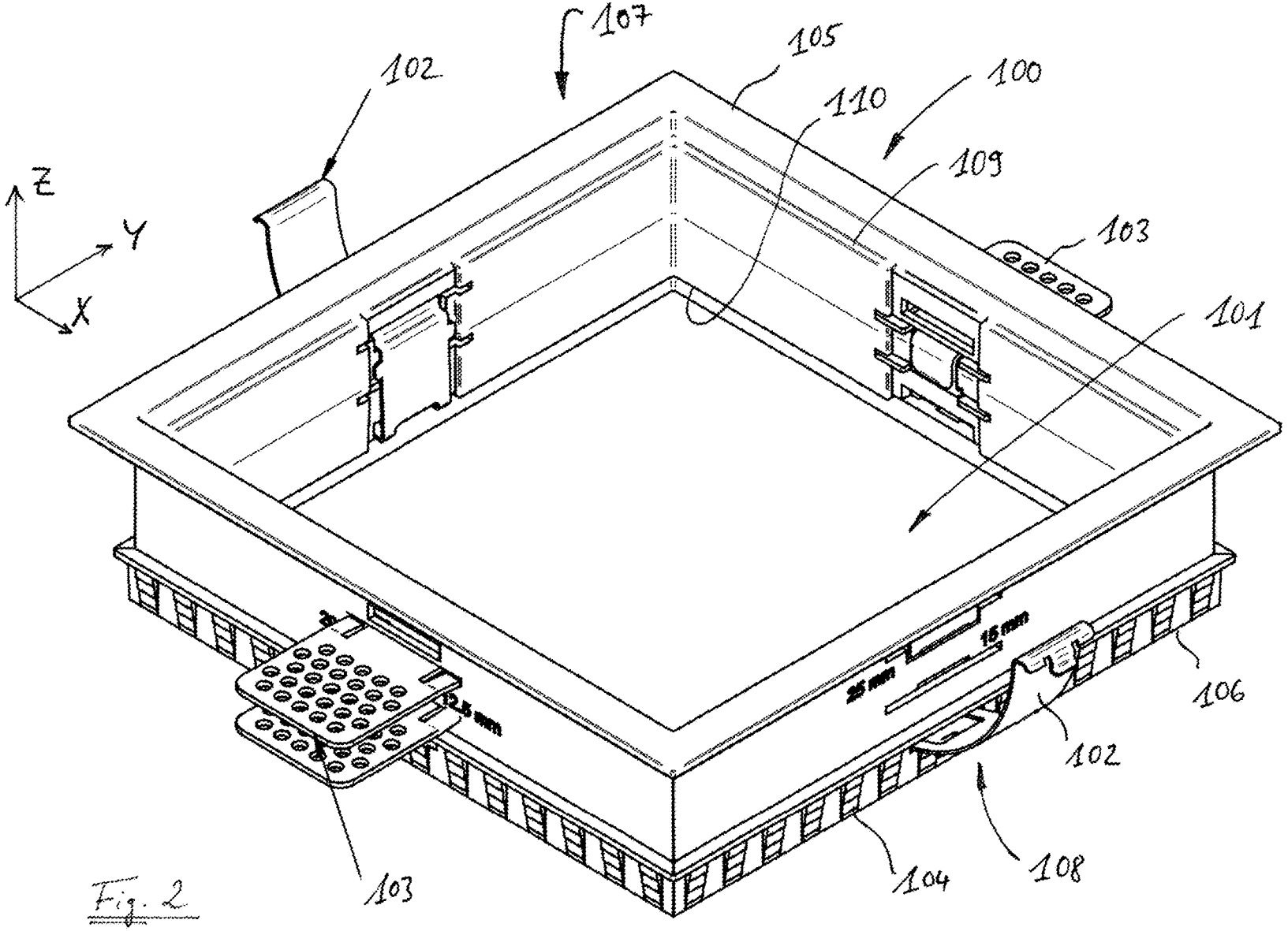
FIG. 2 shows an installation frame for the luminaire in accordance with the exemplary embodiment, in perspective view.
Figure 3:
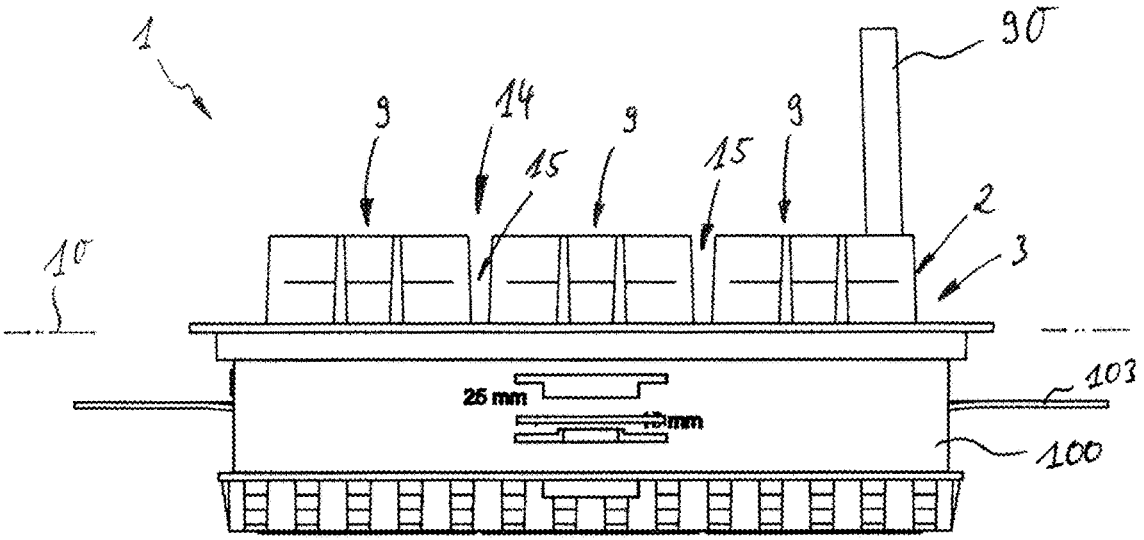
FIG. 3 shows the luminaire in accordance with the exemplary embodiment, with the housing component inserted into the installation frame for "rimless" installation, in a side view.
Figure 4:
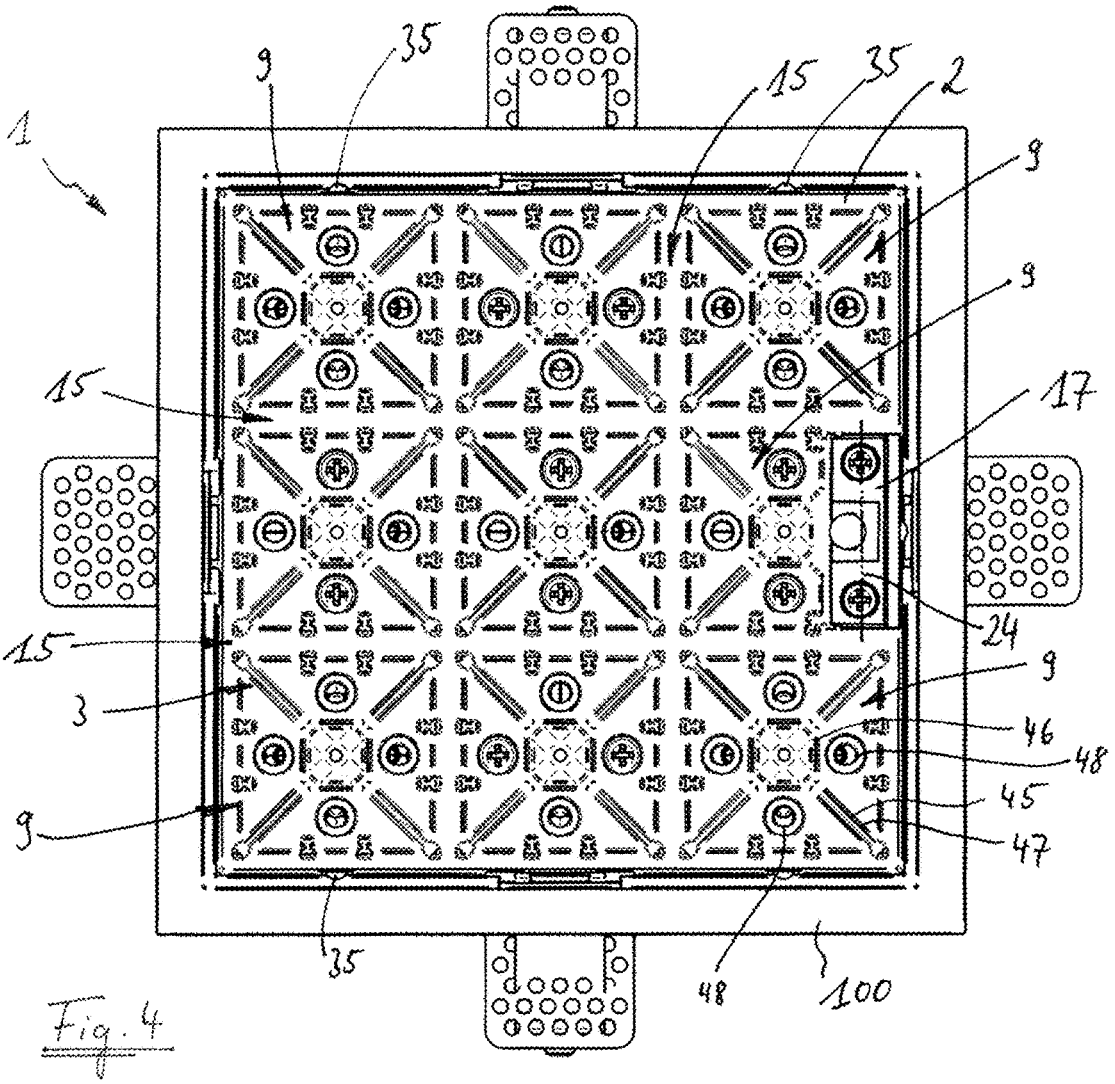
FIG. 4 shows the luminaire from FIG. 3 in a plan view.

The housing component 2 is insertable into an installation frame 100, illustrated separately in FIG. 2. In FIGS. 4, 5, 7, 9 and 10, the housing component 2 is illustrated in each case in a state inserted into the installation frame 100.

The installation frame 100 is formed with a substantially square basic area and has an inner region 101, the shape of which corresponds to the outer shape of the housing component 2 and which is provided for accommodating the housing component 2. The housing component 2 can be inserted into the inner region 101 from a first open side 107 and alternatively from a second open side 108 of the installation frame 100. Inner side surfaces of the installation frame 100 facing the inner region 101 are provided with edges 109 and 110 facing away from one another, wherein the edges 109, 110 are provided on all four inner side surfaces of the installation frame 100. Spring-loaded balls 35 are arranged on the exterior of the housing component 2 in the region of the side walls 20*b* and 20*d*. The edges 109, 110 form circumferential steps behind which the spring-loaded balls 35 can engage in order to hold the housing component 2 on the installation frame 100. Consequently, the housing component 2 can latch with the frame 100 by means of the balls 35 both upon insertion from the first side 107 and upon insertion from the second side 108.

Upon installation in a ceiling, for example, the installation frame 100 can thus be used in two positions, either with a visible rim 105 facing toward a viewing side, or with a rim 106 that is able to be installed invisibly toward the viewing side. In the region of the rim 106, the installation frame 100, at the circumferential exterior thereof, is equipped with structures 104 that facilitate for example the "rimless" installation, for instance by means of applying filler.

In this exemplary embodiment, the securing of the installation frame 100 in a ceiling, not illustrated more specifically in the figures, can be carried out with the aid of securing devices 102 or 103 arranged on the exterior of the installation frame 100, see FIG. 2, for example. The springlike securing devices 102 can be used for mounting the installation frame 100 in such a way that the rim 105 remains visible. By contrast, the securing devices 103 formed as platelike holding elements are provided for mounting the installation frame 100 in the inverted position and thus with the non-visible rim 106 toward the viewing side. The securing devices 103 are insertable into the installation frame 100 on the exterior thereof at different heights relative to the rim 106 in order to be able to take account of different thicknesses of a suspended ceiling.

Figure 10:
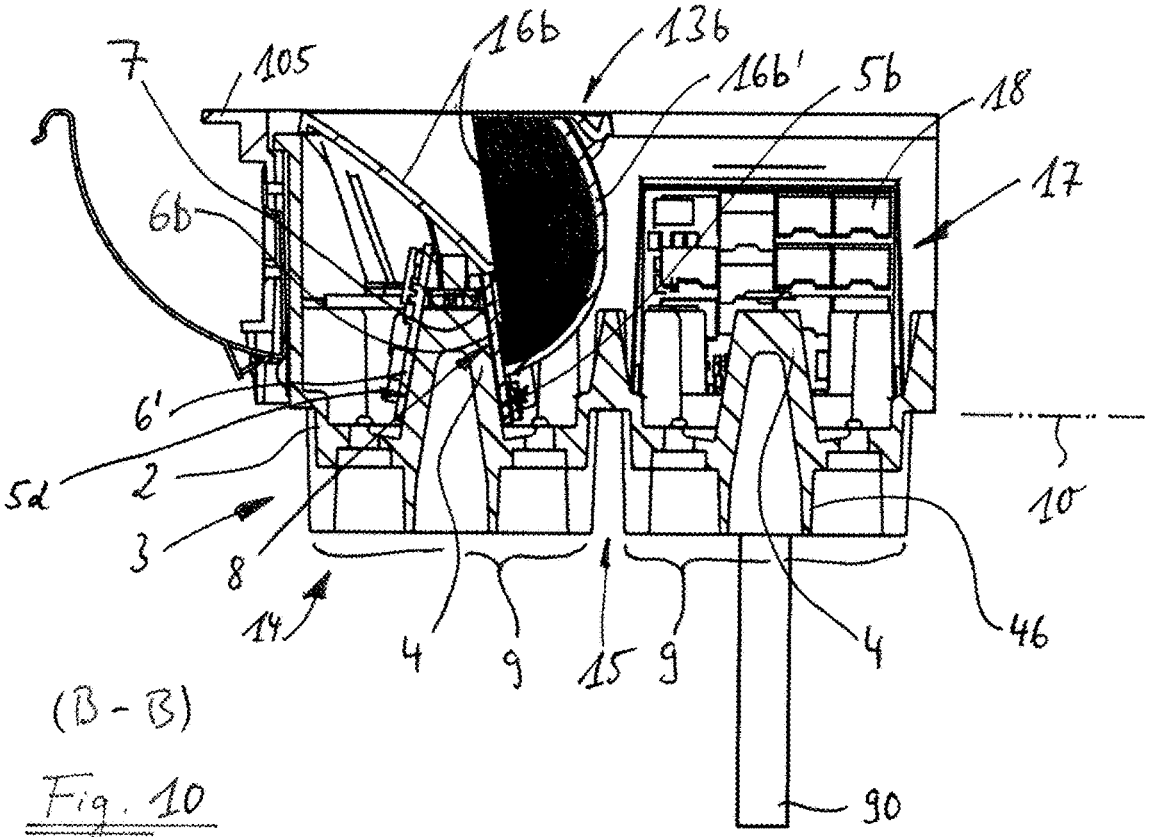
FIG. 10 shows a partial section B-B through the partly equipped housing component from FIG. 5, wherein the installation frame is used in a manner oriented relative to the housing component oppositely to FIG. 9.
Figure 9:
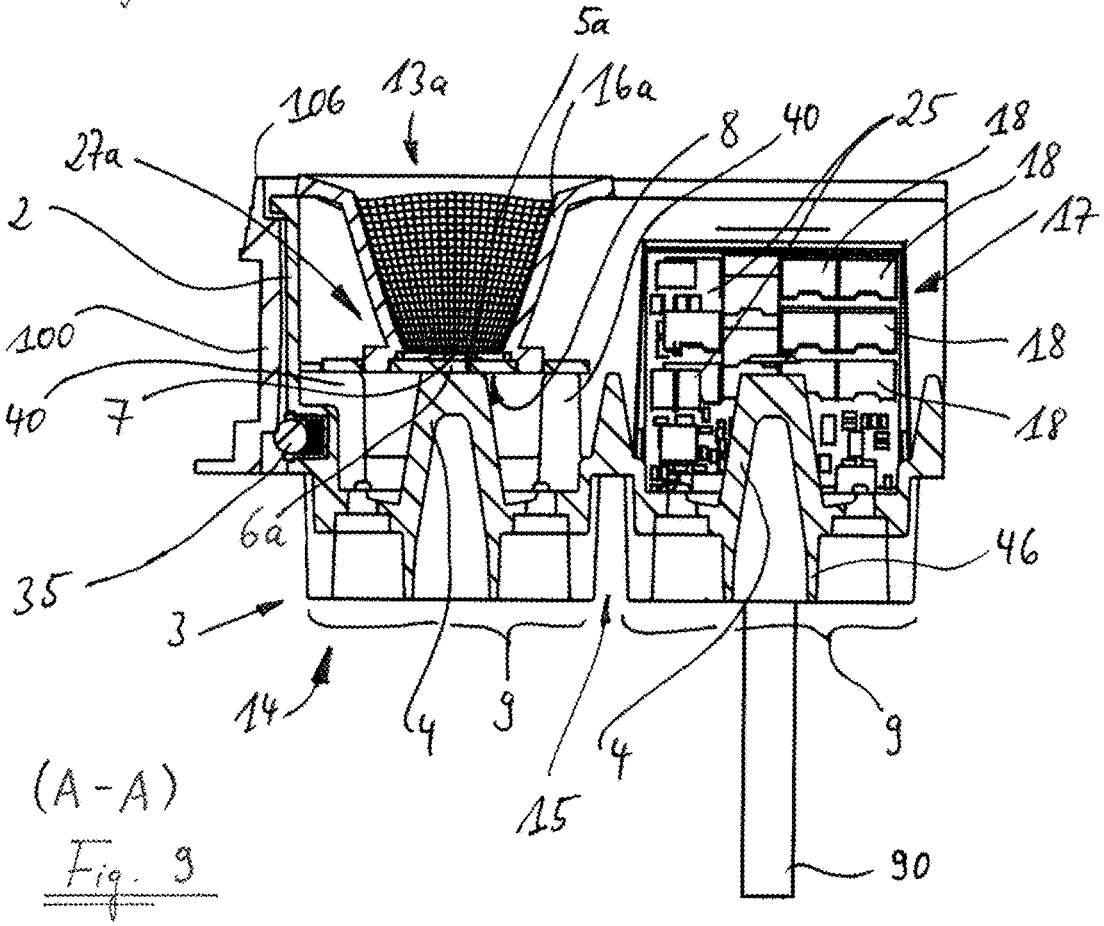
FIG. 9 shows a partial section A-A through the partly equipped housing component from FIG. 5, wherein the installation frame is oriented relative to the housing component as in FIG. 3.

It should be pointed out at this juncture that the section A-A illustrated in FIG. 9 shows the orientation of the installation frame 100, unlike the section B-B in FIG. 10, in an installation position in which the rim 106 faces toward the viewing side of the installed luminaire 1. The possibility of installation in both of the explained positions of the installation frame 100 is intended to be illustrated in this way.

The luminaire 1 makes it possible to change between different light effects or light scenes in diverse ways by means of corresponding switching and/or control. The luminaire 1 provides a flexible and compact lighting solution that enables a wide variety of lighting effects to be achieved. For this purpose, in the case of the luminaire 1, a plurality of optical components 16, which are in each case reflectors in the exemplary embodiment illustrated, are combined with one another within the housing component 2. In particular, the optical components 16 combined with one another in the housing component 2 are formed differently and generate different emission characteristics.

Figure 5:
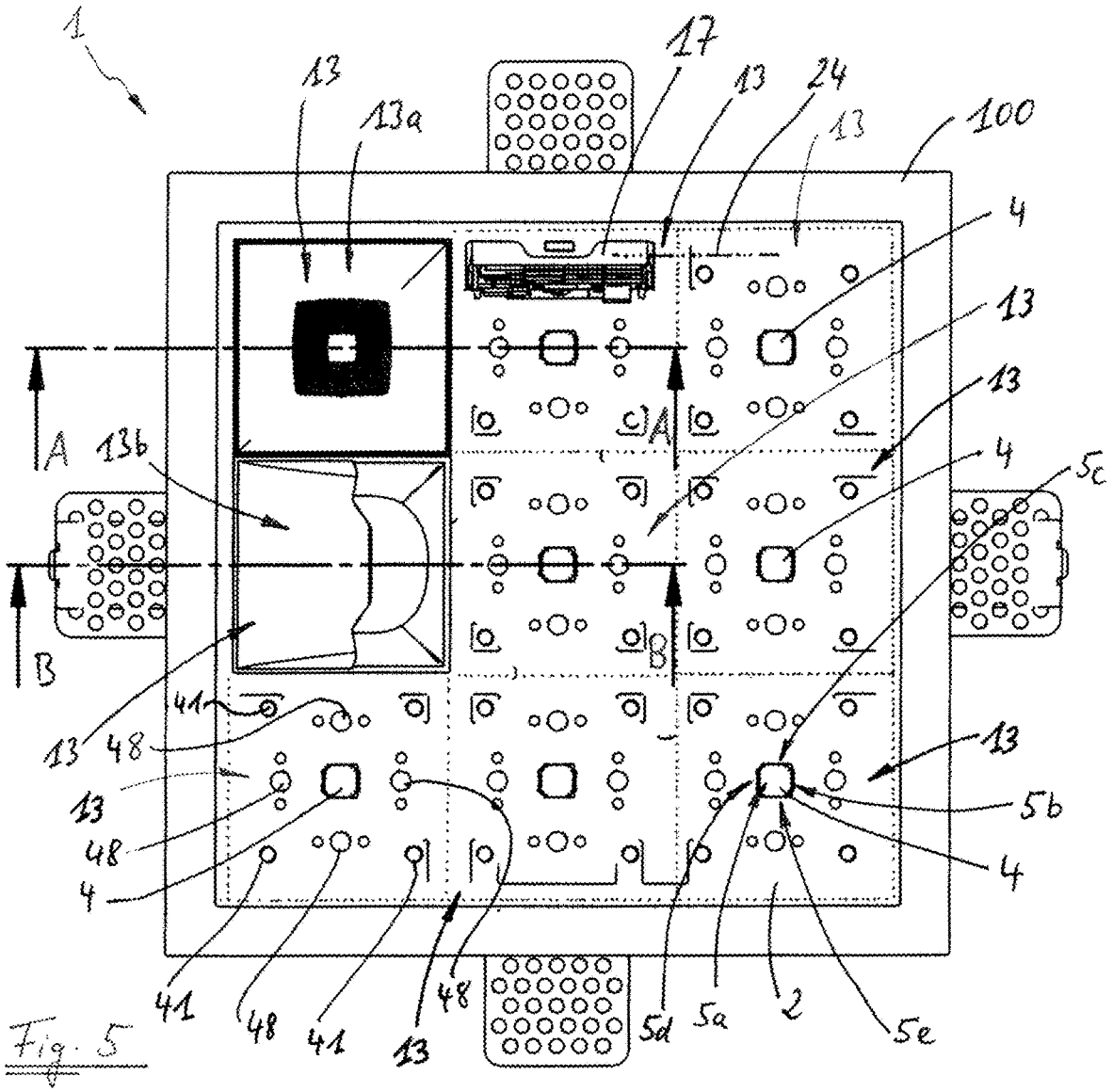
FIG. 5 shows the luminaire from FIG. 3 in a bottom view, with a partly equipped housing component as in FIG. 1.
Figure 6:
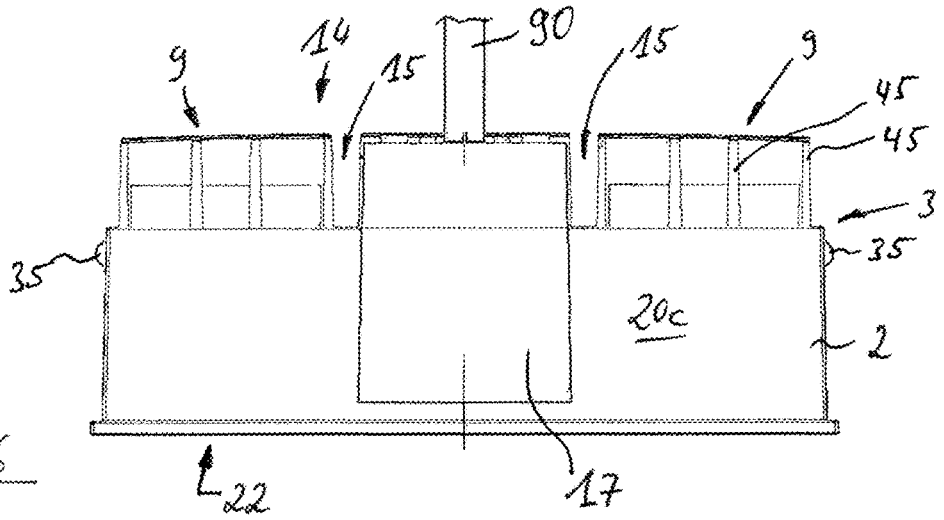
FIG. 6 shows the housing component from FIG. 1 in a side view.
Figure 7:
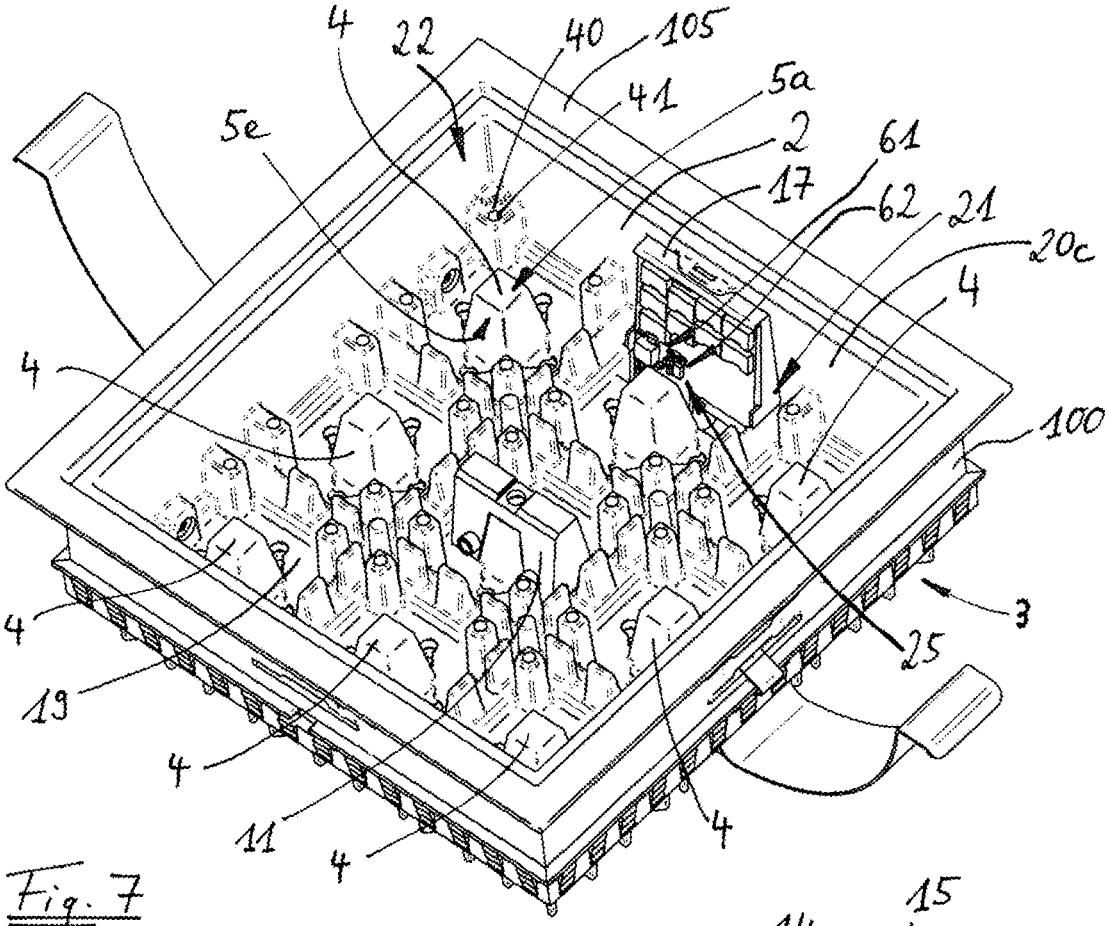
FIG. 7 shows a perspective bottom view of the housing component of the luminaire inserted into the installation frame in accordance with the exemplary embodiment, with modified securing devices for the installation frame, wherein the housing component is still empty apart from a connection and control unit and a single adapter component inserted by way of example.

Consequently, the luminaire 1 makes it possible to arrange different optical components 16 in different positions within a uniform housing component 2 in a wide variety of ways. In the exemplary embodiment shown, here an optical component 16 having an outer shape that is square in plan view is arranged in each function field 13. In FIGS. 1 and 5, for the sake of better illustration of the housing component 2, only two different optical components 16—here reflectors—are illustrated, but in the case of a luminaire 1 in a completed state preferably all of the function fields 13 are filled or equipped and none of the function fields 13 remains empty.

Light to be emitted by the luminaire 1 is provided by LED devices 7, which are formed as or comprise LEDs or groups of LEDs. The LED devices 7 are illustrated by way of examples in FIGS. 9, 10, 15. Each of the LED devices 7 is arranged on an LED carrier circuit board 6 that carries the LED device 7. The luminaire 1 thus comprises a plurality of LED devices 7 which are in each case assigned to a function field 13 and are arranged in said function field 13. In the luminaire 1 in accordance with the exemplary embodiment, a plurality of mutually different LED carrier circuit boards 6 are combined with one another and secured in the inner region 21 within the housing component 2. This will be explained in greater detail below. Two different LED carrier circuit boards 6 and assigned optical components 16 shall be designated below for example by the reference signs 6*a* and 6*b*, and respectively 16*a* and 16*b*.

FIG. 1 shows by way of example a first optical component 16*a*, which is formed as a reflector and is arranged in a first function field 13*a*. In this case, the first function field 13*a* forms a first luminous field, to which the reflector 16*a* imparts a first emission characteristic, corresponding to the emission characteristic of a downlight. In this example, the emission characteristic of the first function field 13*a* thus corresponds to an emission characteristic of a single luminaire which radiates along a main emission direction substantially perpendicular to the main extension plane 10, that is to say downward in the case of ceiling mounting, and generates for example a circular or elliptic, more or less focused light cone.

A first LED carrier circuit board 6*a* is arranged in the function field 13*a*, said first LED carrier circuit board being secured substantially horizontally in FIG. 1, and thus parallel to the main extension plane 10 of the base 3, in the inner region 21 of the housing component 2. The securing means of the LED carrier circuit board 6*a* is placed onto four sections 40 arranged around a projecting section 4 that is not visible in FIG. 1 because it is concealed by the LED carrier circuit board 6*a*, and is screwed to the housing component 2 by means of screws and securing openings 41 of said sections 40.

The optical component 16*a* is arranged on the LED carrier circuit board 6*a* in FIG. 1, wherein the optical component 16*a* can be in particular plugged onto the LED carrier circuit board 6*a* and latched with the latter. In other words, the LED carrier circuit board 6*a* is situated in the function field 13*a* between the base 3 and the optical component 16*a*.

Reference will now be made to FIG. 9. The LED carrier circuit board 6*a* carries the LED device 7 on its front side facing upward in FIG. 9, while the LED carrier circuit board 6*a*, by its rear side 8, which is oriented oppositely to the front side carrying the LED device 7 and faces downward in FIG. 9, is seated on the top surface 5*a* of the section 4 in the region of the LED device 7. Depending on the size and positioning of the LED device 7, the rear side 8 of the LED carrier circuit board 6*a* can be arranged on the top surface 5*a* completely or at least partly in that region in which the LED device 7 is situated on the opposite front side. The rear side 8 of the LED carrier circuit board 6*a* is thus seated in sections on the top surface 5*a* in such a way that the LED device 7 overlies the top surface 5*a* at least partly, and in respect of a relatively large part in the example in FIG. 9. Essentially the entire top surface 5*a* bears against the rear side 8 of the LED carrier circuit board 6*a* in the example shown in FIG. 9.

During operation of the LED device 7, the latter generates not only light but also heat, which is dissipated in the case of the luminaire 1, as a result of the contact between the rear side 8 of the LED carrier circuit board 6*a* and the top surface 5*a*, effectively and efficiently via the domelike section 4 into the region 9 assigned to the section 4 and formed as a heatsink. In the region 9, the heat can then be dissipated further, in particular emitted to the surrounding air by convection. Effective cooling of the LED device 7 is achieved even with a small height of the luminaire 1 and of the housing component 2.

The LED carrier circuit board 6 with the LED device 7 carried thereby and the optical component 16*a* can form a first assembly 27*a*.

A second optical component 16*b*, which differs from the optical component 16*a*, is arranged in the second function field 13*b*, see FIG. 1. The second optical component 16*b* imparts to the second function field 13*b*, which forms a further luminous field in this example, a second emission characteristic, corresponding to the emission characteristic of a wallwasher. In other words, in the case of ceiling mounting of the luminaire 1, a main emission direction of the function field 13*b* is not perpendicular to the main extension plane 10, but rather at an inclination with respect thereto, in such a way that a wall can be illuminated, for example.

Reference is made to FIG. 10. A second LED carrier circuit board 6*b* is arranged in the second function field 13*b*, said second LED carrier circuit board in turn carrying an LED device 7 on a front side. See also FIG. 15, in which the carrier circuit board 6*b* and the LED device 7 are revealed in an enlarged manner. A rear side 8 of the LED carrier circuit board 6*b* facing away from the front side carrying the LED device 7 is seated in sections on one of the inclined surfaces 5*b* to 5*e* of the section 4, for example on the surface 5*b* in FIG. 10. Consequently, the rear side 8 of the LED carrier circuit board 6*b* in FIG. 10 is arranged in sections on one of the lateral surface sections of the section 4 in the region of the LED device 7 assigned to the second function field 13*b*. The rear side 8 is thus seated in sections on one of the surfaces 5*b* to 5*e*, here 5*b*, in FIG. 10 in such a way that the LED device 7 overlies the surface 5*b* regionally. In FIG. 10, here the arrangement of the LED carrier circuit board 6*b* is such that the LED device 7 carried by the LED carrier circuit board 6*b* projects beyond an upper end of the section 4 and thus beyond the top surface 5*a*. A large part of the inclined surface 5*b* bears against the rear side 8 of the LED carrier circuit board 6*b* in FIG. 10.

The LED carrier circuit board 6*b* in FIG. 10 is thus oriented differently from the LED carrier circuit board 6*a* in FIG. 9. In FIG. 10, the LED carrier circuit board 6*b* is greatly inclined with respect to the main extension plane 10 of the base 3, in a manner corresponding to the inclination of the surface 5*b* relative to the plane 10. The inclination of the surfaces 5*b*-5*e* relative to the plane 10 can be for example between 75 degrees and 85 degrees, and is 81 degrees for example in the exemplary embodiment shown.

Figure 15:
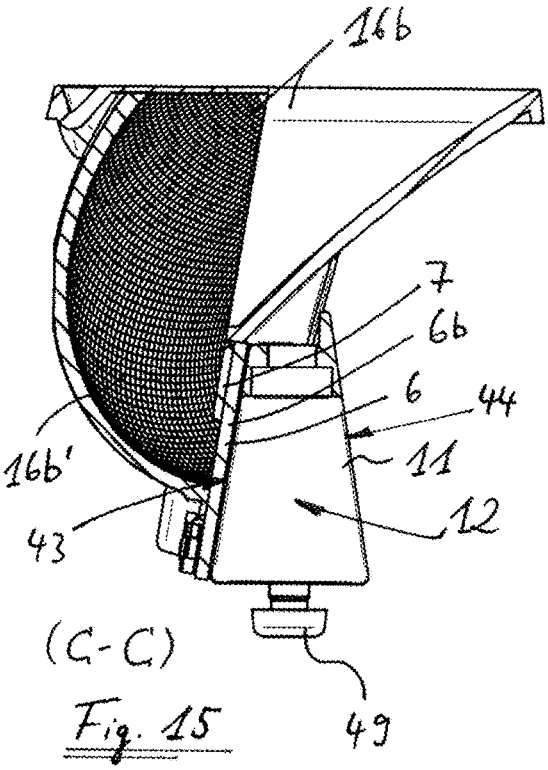
FIG. 15 shows the assembly as in FIG. 14 in a section C-C.

The optical component 16*b*, see FIG. 15, for example, is formed with a reflective section 16*b*', which is shaped in a curved fashion and enables light to be laterally emitted and directed, at an inclination with respect to the plane 10. In a lower region in FIGS. 10 and 15, the LED device 7, which is likewise inclined in a manner corresponding to the inclination of the LED carrier circuit board 6*b*, radiates light into the reflective section 16*b*'. The section 16*b*' can be formed as an integral part of the optical component 16*b*, or the optical component 16*b* can be constructed in a multipartite fashion, wherein the section 16*b*' can form a segment of the optical component 16*b* and be joined together with an additional covering element.

The LED carrier circuit board 6*b* and also a further circuit board 6' are secured to an adapter component 11 by means of screws 42, which adapter component will now be described in greater detail.

Figure 11:
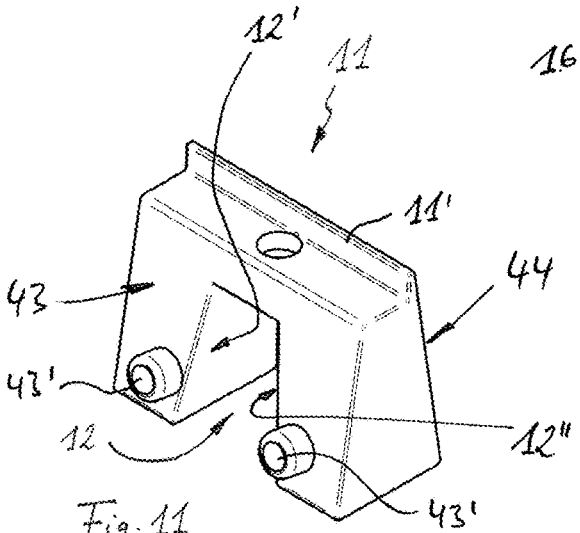
FIG. 11 shows an adapter component for the luminaire in accordance with the exemplary embodiment, in perspective view.
Figure 14:
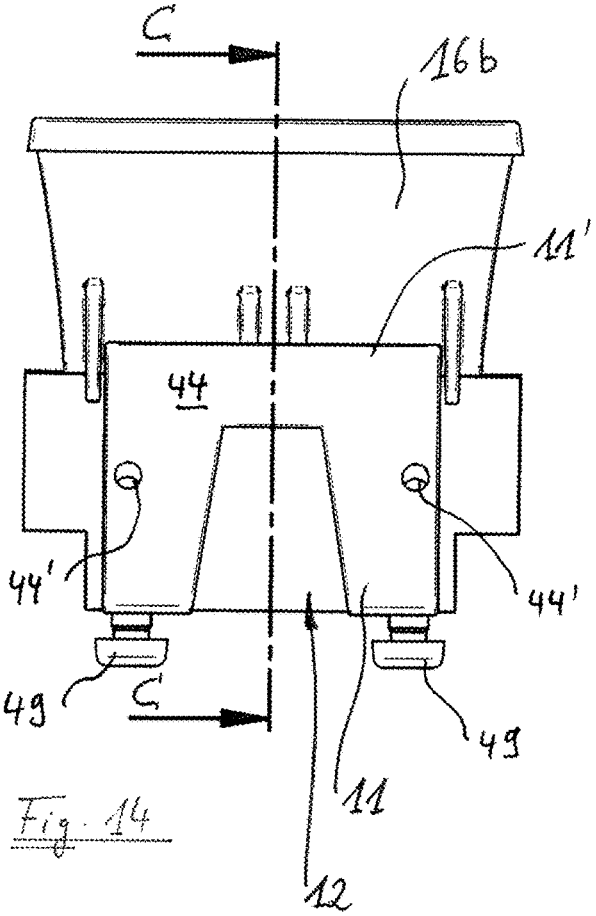
FIG. 14 shows the assembly from FIG. 12, wherein one of the circuit boards is omitted, in a rear view.

The adapter component 11, see in particular FIGS. 11 to 15, has an outer shape in the manner of a horizontal prism modified by a step 11' at an upper long side in FIG. 11 and by a large cutout 12 at the opposite, lower long side in FIG. 11. The cutout 12 has a shape chosen in such a way that the size and inclination of inclined planar inner surfaces 12' and 12" correspond to the size and inclination of two opposite surfaces from among the surfaces 5*b*-5*e* of the section 4.

The adapter component 11 has inclined first and second side surfaces 43 and 44 facing away from one another, the inclination of which in turn respectively corresponds to that of two opposite surfaces from among the surfaces 5*b* to 5*e* of the projecting section 4 and to which the cutout 12 is open. In other words, in a manner analogous to that for the section 4, the outer shape of which corresponds to a regular truncated pyramid having a square base area, all the surfaces 12', 12", 43 and 44 of the adapter component 11 are arranged with the same inclination relative to the main extension plane 10 of the base 3. The section 4 projecting from the base 3 can thus be accommodated in the cutout 12 in four angular positions, respectively offset by 90 degrees relative to one another, about the centre axis of the section 4, in such a way that the cutout 12 is substantially completely filled and the accommodated part of the section 4 in each case does not project beyond the surfaces 43 and 44.

The adapter component 11 is integrally die-cast from a metal material, for example aluminium or an aluminium alloy, for example manufactured from the same material as the housing component 2.

Figure 12:
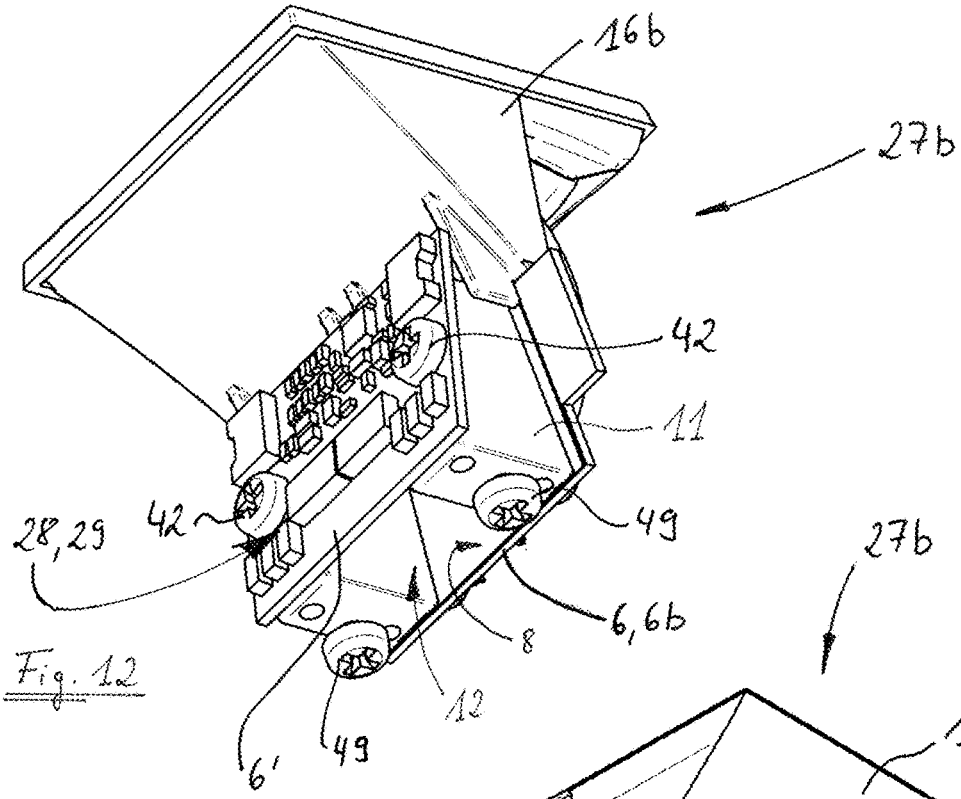
FIG. 12 shows an assembly comprising an optical component, circuit boards and the adapter component from FIG. 11, in perspective view from a side that is not visible in the installed state.

In order to arrange the LED carrier circuit board 6*b* by its rear side 8 on one of the surfaces 5*b* to 5*e* in the manner described, the LED carrier circuit board 6*b* is arranged on the first side surface 43 and secured by means of the screws 42, while the further circuit board 6' is arranged on the second side surface 44 of the adapter component 11 and secured by means of further screws 42, see FIG. 12. For securing the circuit boards 6*b*, 6', the adapter component 11 is provided with securing openings 43', 44' in the region of the side surfaces 43 and 44.

Furthermore, the optical component 16*b* can be plugged onto the adapter component 11 and be secured and held on the adapter component 11 for example by means of suitable securing means, for instance by latching or screwing.

Figure 13:
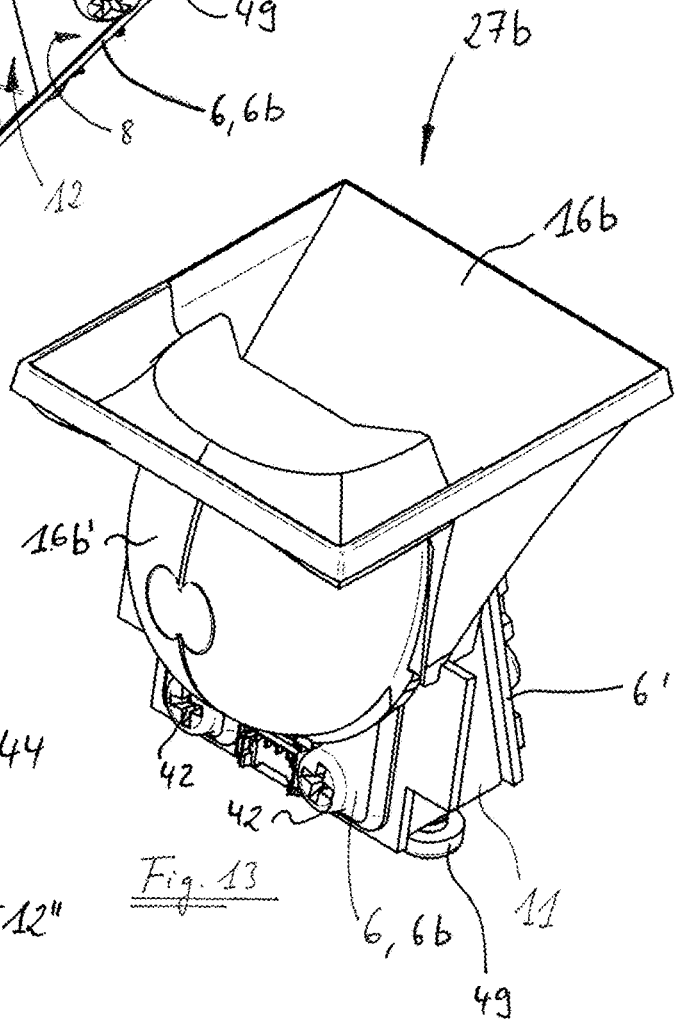
FIG. 13 shows the assembly from FIG. 12, in perspective view from a side that is visible in the installed state.

An assembly 27*b* formed with the optical component 16*b*, the circuit boards 6' and 6*b* and the adapter component 11, see FIGS. 12 and 13, can then be placed onto one of the projecting sections 4 of the housing component 2 in one of the four angular positions mentioned. In FIG. 1, for example, the surfaces 12' and 12" are seated on the inclined surfaces 5*c* and 5*e*, respectively.

In the bottom 19 of the housing component 2, see FIG. 5, the base 3 is provided with further securing openings 48 arranged around the projecting section 4, wherein a respective securing opening 48 is arranged in front of each of the inclined surfaces 5*b* to 5*e*. Consequently, the securing openings 48 are arranged at an angular distance of 90 degrees regularly around the centre axis of the section 4, said centre axis being parallel to the direction Z, within the respective function field 13, and within an imaginary quadrilateral defined for each function field 13 by the assigned securing openings 41. The adapter component 11 can thus be secured to the housing component 2 and pulled against the section 4 in each of the four angular positions by screwing from the rear side 14 of the base 3 by means of screws 49 and the securing openings 48. In this way, the adapter component 11 also makes good contact with the section 4. The adapter component 11 is provided with suitable openings, not designated in more specific detail, into which the screws 49 are able to be screwed through the openings 48.

The adapter component 11 thus makes it possible for the projecting section 4, without rework on the housing component 2 being necessary, also to be used for equipping the function field 13*b* in the manner of a wallwasher. In the case of the function field 13*b*, the rear side 8 of the LED carrier circuit board 6*b* bears regionally on the inclined surface 5*b* of the section 4, and regionally on the first side surface 43 of the adapter component 11. In particular, see FIG. 10, the rear side 8 bears against the surface 43 partly in the region of the LED device 7 arranged on the opposite front side, while a further part of the rear side 8 is seated on the surface 5*b* in the region of the LED device 7, as a result of which the LED device 7 overlies the surface 5*b* regionally. It should be mentioned that in variants the position of the LED device 7 can vary in such a way that the rear side 8 is seated on the surface 5*b* substantially completely in the region of the LED device 7. Alternatively, a large part of the rear side 8 can be seated on the surface 43 in the region of the LED device 7, wherein, in the latter case, the rear side 8 of the LED carrier circuit board 6*b* is nevertheless arranged on the inclined surface 5*b* of the section 4—or, depending on the orientation of the adapter component 11 and thus of the optical component 16*b*, one of the further inclined surfaces 5*c*, 5*d* or 5*e*—in such a way that the LED device 7 still overlies said inclined surface, here 5*b*, regionally. In this way, via the section 4, the heat generated by the LED device 7 during operation can in turn be dissipated effectively into the region 9, from which it is dissipated further. The circuit board 6', too, can be seated by the rear side thereof on the surface 5*d*.

Figure 8:
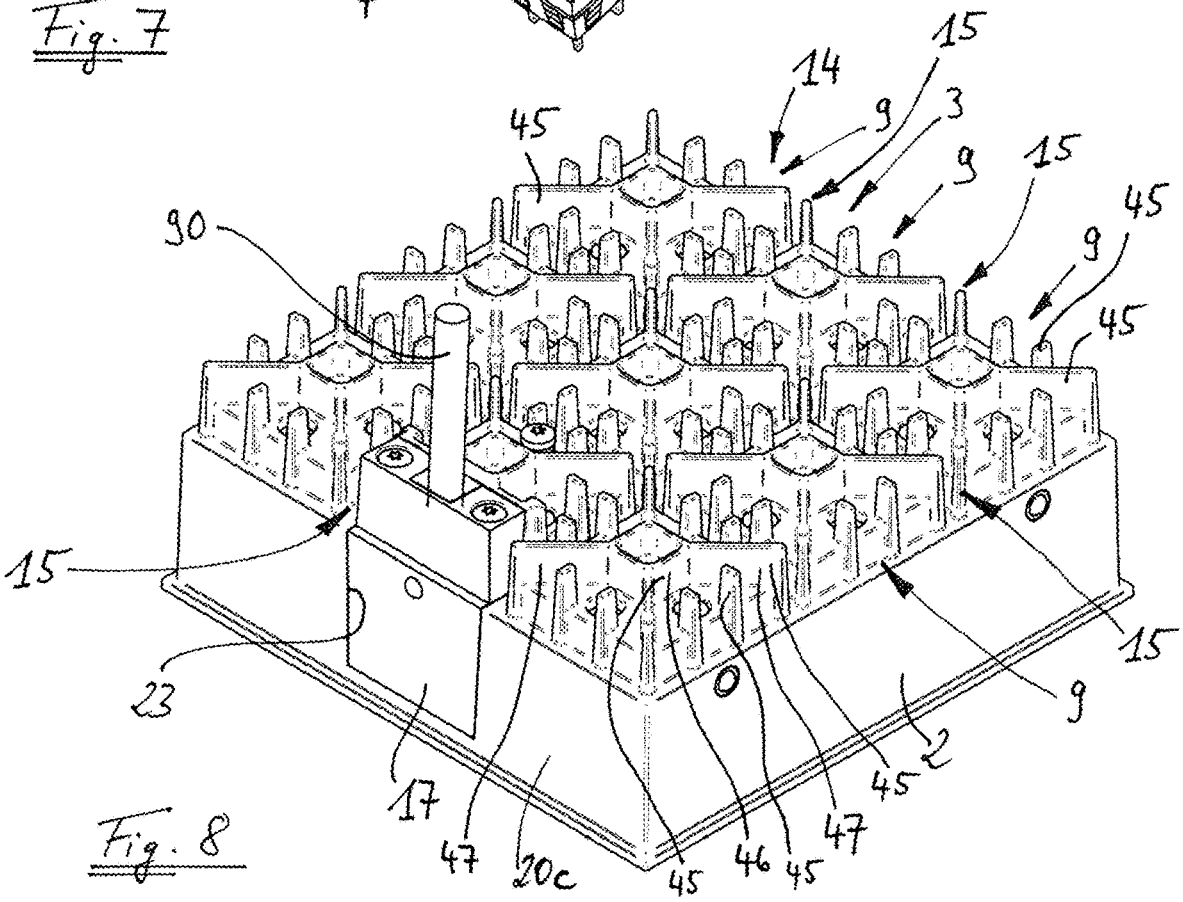
FIG. 8 shows the housing component of the luminaire in accordance with the exemplary embodiment in a perspective plan view.

With regard to the region 9, FIGS. 9 and 10 additionally show that walls of the domelike section 4 continue on the rear side 14 of the base 3 in cooling ribs 46 connected in the manner of a quadrilateral, see FIG. 8. A further cooling rib 47 proceeds radially in each case from corner regions of the ribs 46 connected as a quadrilateral.

Thus a region 9 formed as a heatsink is assigned to each function field 13 and thus to each LED device 7 in order to effectively cool the LED device 7 in each case.

The function fields 13, not yet equipped in FIGS. 1, 5, are likewise equipped in order to complete the luminaire 1 by means of further LED carrier circuit boards 6 with LED devices 7 carried by the latter being secured in the housing component 2. In this case, once again for each of the LED devices 7, the heat generated thereby during operation is dissipated into the respectively assigned region 9. The further function fields 13 can be configured in each case as luminous fields for example in the manner of a downlight, such as in the case of the function field 13*a*, for instance, or in the manner of a wallwasher, such as in the case of the function field 13*b*, for instance. The nine function fields 13 in FIGS. 1, 5 thus yield a multiplicity of combination possibilities within the housing component 2.

An individual LED carrier circuit board 6 can be provided for each of the function fields 13, wherein each of the LED carrier circuit boards 6 then carries an LED device 7. However, LED devices 7 of mutually adjacent function fields 13 for which the LED devices 7 are intended to be arranged in the housing component 2 in a manner oriented relative to the projecting section 4 in the same way can also be arranged on a common LED carrier circuit board 6.

Figure 16:
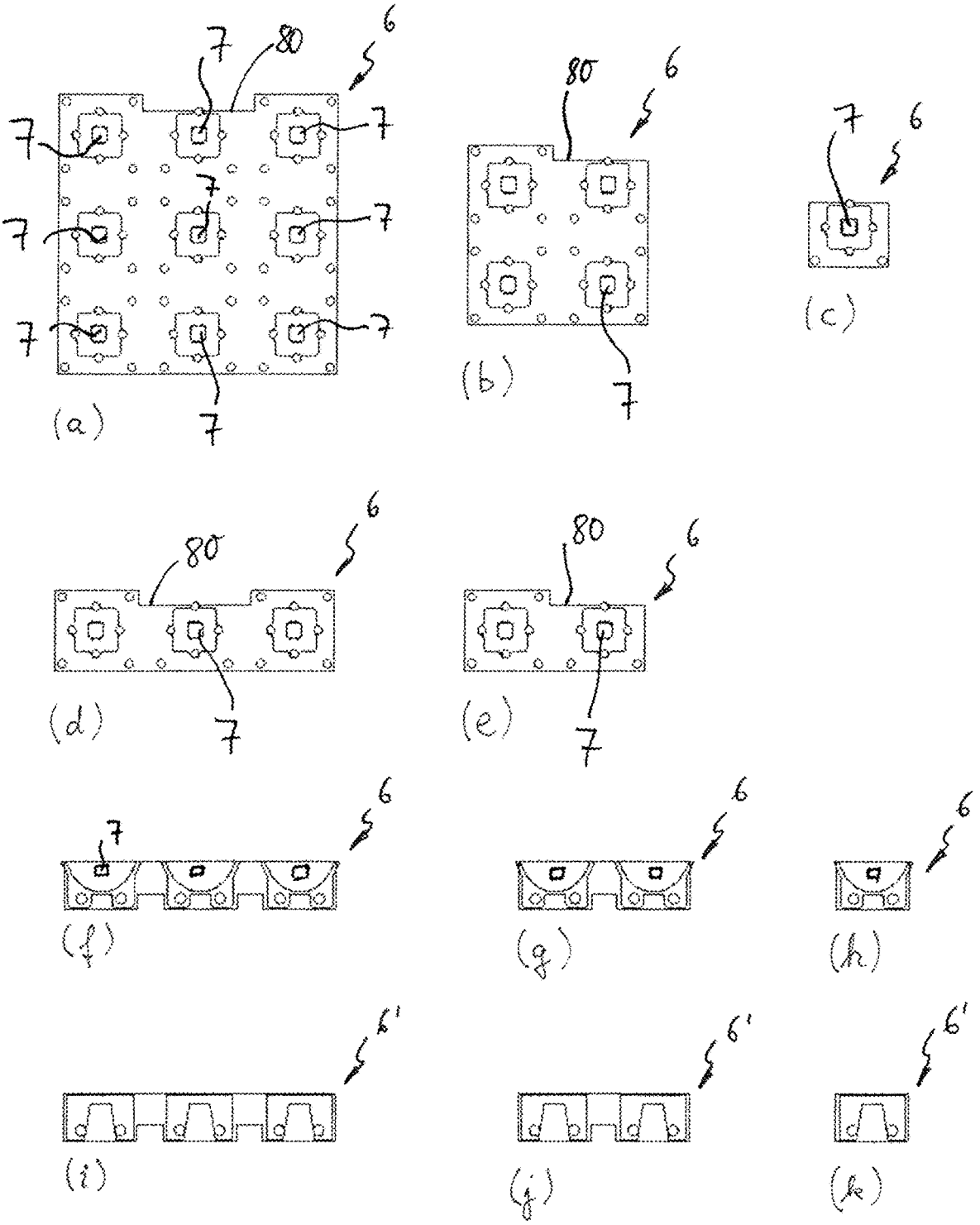
FIG. 16 show a multiplicity of exemplary LED carrier circuit boards and further circuit boards.

This is illustrated by way of example in FIG. 16. FIG. 16 (*a*) shows an LED carrier circuit board 6 carrying nine LED devices 7. The LED devices 7 are arranged on the LED carrier circuit board 6 in accordance with a 3×3 arrangement of the projecting sections in the housing component 2. The LED carrier circuit board 6 in FIG. 16 (*a*) can be arranged as a whole in the housing component 2 from FIG. 1 and be secured on a number of the sections 40. In this variant, the LED carrier circuit board 6 bears by its rear side 8, which is not visible in FIG. 16 (*a*), in the region of each of the LED devices 7, on the top surface 5*a* of the section 4 respectively assigned to the LED device 7, in such a way that each of the LED devices 7 overlies the top surface 5*a* of the assigned section 4 at least regionally. By way of example, all the LED devices 7 shown in FIG. 16 (*a*) can be provided for providing light in the manner of a downlight in each of the function fields 13 in interaction with corresponding, possibly different, optical components 16.

FIG. 16 (*b*) shows a group of four LED devices 7 arranged in a 2×2 grid, said LED devices being carried by an LED carrier circuit board 6 in accordance with a further variant, while FIG. 16 (*c*) illustrates an LED carrier circuit board 6 with a single LED device 7.

Further LED carrier circuit boards 6 are shown in FIGS. 16 (*d*) and 16 (*e*), for example for a linear arrangement of three LED devices 7 arranged next to one another in a row, or for two LED devices 7 arranged next to one another.

The LED carrier circuit boards 6 illustrated in FIGS. 16 (*a*) to 16 (*e*) are configured to be arranged by their rear side 8 in each case in sections on the top surface 5*a*. To put it another way, said LED carrier circuit boards 6 are placed onto the sections 4 from above in FIG. 1.

FIG. 16 furthermore shows, in subfigures (f) to (k), that in the case of LED carrier circuit boards 6 to be arranged laterally, i.e. on the inclined surfaces 5*b* to 5*e* at the rear side in sections, for example in order to make possible wall-washer luminous fields analogously to the function field 13*b* described above, a plurality of LED devices 7 can likewise be arranged on an LED carrier circuit board 6. By way of example, FIG. 16 (*f*) shows the configuration of an LED carrier circuit board 6 for three LED devices 7 to be arranged next to one another in a row, said LED devices facing in the same direction in the completed luminaire 1, in other words the LED carrier circuit board 6 der FIG. 16 (*f*) can be arranged in the housing component 2 in such a way that said circuit board 6 is seated by its rear side, not visible in FIG. 16, in sections on a respective inclined surface 5*b*-5*e* of three sections 4 arranged next to one another in the housing component 2 in such a way that each of the LED devices 7 overlies the inclined surface of the assigned section 4 at least regionally. The circuit board 6 in FIG. 16 (*f*) can thus be seated by its rear side 8 for example in sections respectively on the surface 5*b* of three sections 4 arranged next to one another, wherein a respective adapter component 11 is then placed onto the three sections 4 arranged next to one another.

FIGS. 16 (*g*) and 16 (*h*) reveal that an LED carrier circuit board 6 can also be provided in each case for two LED devices 7 arranged next to one another, and for a single LED device 7, which are and respectively is to be arranged in an inclined manner in the housing component 2.

Furthermore, FIG. 16 shows in subfigures (i) to (k) further circuit boards 6', for three or two LED devices 7 arranged next to one another, and for a single LED device 7, analogously to the arrangement in FIGS. 12, 13. By way of example, the circuit board 6' in FIG. 16 (*d*) can also be secured to three adapter components 11 arranged next to one another.

Each of the LED devices 7 of the luminaire 1 is assigned to one of the function fields 13 and arranged in the respectively assigned function field 13. Within a luminaire 1, until the housing component 2 is completely equipped, LED carrier circuit boards 6 of different types, as illustrated in FIG. 16, can be combined with one another. Consequently, a wide variety of lighting requirements can be taken into account in the configuration of the luminaire 1. Some of the function fields 13 can emit light in the manner of a downlight, for example, while other function fields 13 act as a wallwasher. Rework of the housing component 2 is not required. Depending on the requirements, the number and/or the cutting to size of the LED carrier circuit boards 6 and possibly the number of adapter components 11 used can vary.

With regard to FIG. 16, it should also be pointed out that the LED carrier circuit boards 6 can have a cut-out section 80, the function of which will be explained below.

Even though the housing component 2 can be filled completely in a manner such that each function field 13 forms a luminous field, in one variant provision can be made for a sensor device 50 to be arranged in one of the function fields 13 instead of an LED device 7. The sensor device 50 could be provided on an individual circuit board provided specifically therefor, or be arranged on one of the LED carrier circuit boards 6 instead of an LED device 7. The function field 13 equipped with the sensor device 50 could furthermore be provided with an optical component adapted to the sensor device 50 and/or with a suitable covering (not illustrated) adapted to the shape of the function field 13 and to the function of the sensor device 50. The sensor device 50 can be for example a presence sensor, a brightness sensor, a moisture sensor or a temperature sensor or some other desired sensor.

The luminaire 1 is formed as a uniform luminaire comprising, in the exemplary embodiment shown, a plurality of light sources which are formed by the LED devices 7 and to which a respective optical component 16 is assigned. The plurality of light sources are switchable and/or controllable flexibly, for example individually or in different groups, in the case of the luminaire 1 for the purpose of generating different light effects.

The luminaire 1 comprises a connection and control unit 17, see FIGS. 1, 5, 6, 8, wherein the connection and control unit 17 comprises a central control arrangement 25 and a multiplicity of connecting devices 18. The central control arrangement 25 and the connecting devices 18 are arranged for example on a control circuit board of the connection and control unit 17. The connecting devices 18 can be configured for producing plug connections. Each of the LED carrier circuit boards 6 is able to be electrically coupled to the connection and control unit 17 by means of the connecting devices 18.

A recess 23 is introduced into the side wall 20*c* of the housing component 2, said recess being open toward the outer side of the housing component 2 and also extending into the base 3. The recess 23 is provided for accommodating the connection and control unit 17, which is formed in a flat fashion. The connection and control unit 17 is accommodated in the recess 23 in such a way that a main extension plane 24 of the connection and control unit 17, see FIGS. 4 and 5, extends along the side wall 20*c*. The connection and control unit 17 is thus arranged substantially parallel to the side wall 20*c* and substantially in a centre of the side wall 20*c*. The connection and control unit 17 is introduced into the recess 23 from the rear side 14 and projects a little into the inner region 21. The cut-out sections 80 of the LED carrier circuit boards 6 provide space for the connection and control unit 17. The connection and control unit 17, which for example has a housing carrying the control circuit board, does not project beyond the side wall 20*c* on an outer side of the housing component 2, but rather is flush with said side wall.

The central control arrangement 25 can comprise a DALI module for receiving a switching and/or control signal in a wired manner or a Zig Bee module for wirelessly receiving a switching and/or control signal. Electric current for the operation of the luminaire 1 is provided via a connection line 90 coupled to the connection and control unit 17. Furthermore, if switching and/or control signals are received by the control arrangement 25 in a wired manner, the connection line 90 can furthermore provide said switching and/or control signals via corresponding conductors of the connection line 90.

Nine plug-in locations are present on the control circuit board in the example illustrated in FIG. 1, and form nine connecting devices 18. Up to nine plug connections are made possible as a result. Up to nine connections respectively to an LED carrier circuit board 6—one of which for example could be a carrier circuit board for the sensor device 50—can thus be produced, in other word each function field can have a dedicated LED carrier circuit board 6 which is connected to the control arrangement 25 specifically and separately by means of the connecting devices 18. The connections of the LED carrier circuit boards 6 or LED devices 7 to the connecting devices 18 are effected within the inner region 21 by means of flexible cables. In the case of the assembly 27*b* in FIGS. 12, 13, alternatively the connection between LED carrier circuit board 6*b* and connecting device 18 could also be produced in a manner mediated via the circuit board 6', which for its part is coupled to the circuit board 6*b*.

In a variant of the luminaire 1 having high flexibility in the driving of individual function fields 13, the central control arrangement 25 makes possible a multiplicity of control channels, for example eighteen channels. In this variant, the connecting devices 18 are embodied for example as in each case four-pole plug connections, where nine plug connections are provided. In this way, two control channels can be provided for each function field, wherein one of said control channels can be used for dimming the respective LED device 7, i.e. controlling the light intensity, and the second of said control channels can be used for controlling the colour temperature of the light emitted by the LED device 7 ("tunable white"). A luminaire 1 configured in this way is highly flexibly configurable and controllable. The central control arrangement 25 provides two control channels for each LED device 7. The control channels are driven flexibly and individually with the aid of the central control arrangement 25.

Alternatively, the central control arrangement 25 can be configured for providing nine channels if only the light intensity of the individual LED devices 7 is to be controlled. Nine plug connections are provided in this case, too.

In the exemplary embodiment of the luminaire 1, power electronic components 29 as a power electronic arrangement 28 are arranged together with the LED device 7 or the LED devices 7 on the LED carrier circuit board 6 and thus "brought near" to the LED devices 7. Alternatively, at least some power electronic components 29 can be arranged on a further circuit board 6' in the function field 13. FIGS. 12 and 13 illustrate this by way of example for the carrier circuit board 6*b* and the further circuit board 6', wherein the circuit board 6' is likewise secured to the adapter component 11 in the function field 13*b* in a manner adjacent to the LED carrier circuit board 6*b*.

By means of the four-pole plug connections serving as connecting devices 18, and by means of flexible cables, for example, the LED carrier circuit board 6 is coupled to the central control arrangement 25, wherein the four contacts of the plug connections then comprise two contacts for the two control channels, one contact for the supply voltage and one contact for both. By way of example, 48 volts are provided as input supply voltage. In the case of a sensor device 50, the control channels can serve as return channels for the sensor device 50.

The voltage supply brought near via the connection line 90 is thus connected to a single splitter, which distributes the electrical power further and provides a control signal for each control channel.

As described above, the number and embodiment of the LED carrier circuit boards 6 can vary depending on the desired configuration of the luminaire 1. Likewise, it is possible to use different numbers of the provided channels in a luminaire 1.

The central control arrangement 25 comprises a data processing device 62, e.g. a processor, and also a storage medium 61. This is indicated by way of example purely schematically in FIG. 7.

The LED devices 7 are dimmable in an analogue manner in the case of the luminaire 1 in accordance with the exemplary embodiment described above. Analogue dimming using linear regulators is provided for this purpose. Alternatively, switching regulators could be provided.

The assignment of a different number of LED carrier circuit boards 6 at different positions within the housing component 2 to a different number of control channels will be explained in even greater detail below.

There are various possibilities for driving the LED devices 7. In this case, not only is it possible to assign a control channel to a respective LED carrier circuit board 6, but it is also possible to combine a plurality of LED devices 7, independently of whether they are arranged on a common LED carrier circuit board 6 or on a plurality thereof, to form a jointly controllable group. Furthermore, it is also conceivable, in principle, to address two or more LED devices 7 arranged on a common carrier circuit board 6 via different control channels, provided that the LED carrier circuit board is configured for this purpose.

Figure 18:
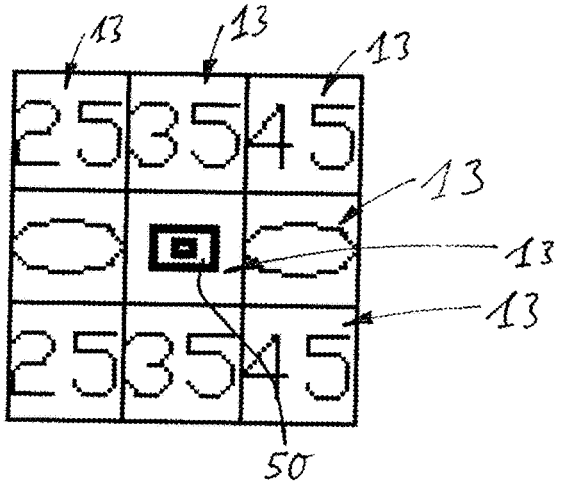
FIG. 18 shows an exemplary configuration of the luminaire in accordance with the exemplary embodiment with a sensor device.
Figure 17:
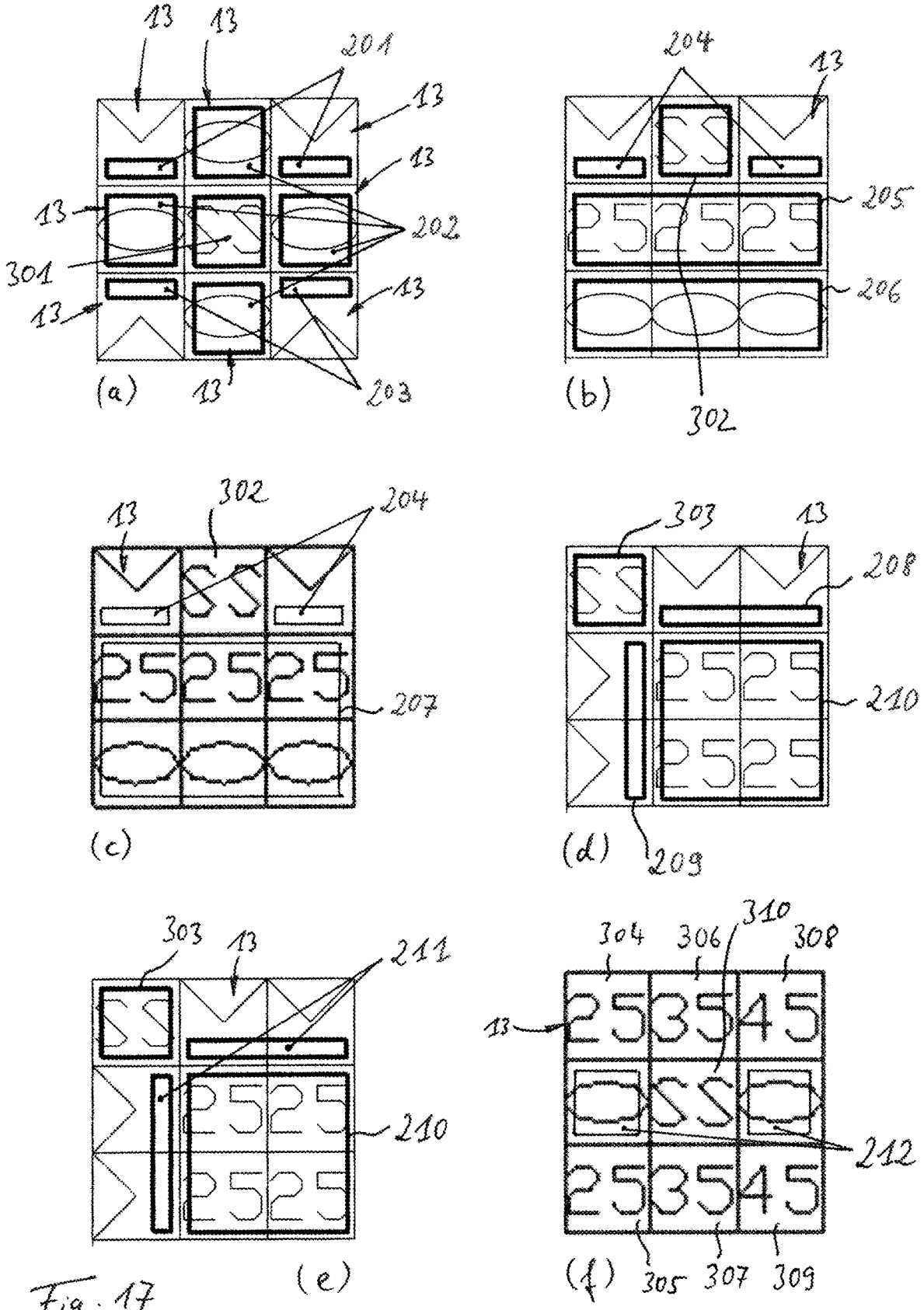
FIG. 17 shows a multiplicity of exemplary configurations of function fields of the luminaire in accordance with the exemplary embodiment.

FIGS. 17 and 18 illustration some possibilities for the configuration of the luminaire 1 in accordance with the exemplary embodiment described above.

FIG. 17 (*a*) shows a configuration of the luminaire 1 in which four function fields 13 each formed with a wallwasher function are provided at the corners of the 3×3 grid. Two of the wallwasher fields form a driveable group 201, while two further wallwasher fields form a further group 203, which is driveable separately from the group 201. Downlight function fields 13 having an elliptic light distribution are arranged in the centres of the sides of the 3×3 grid, which function fields can be driven jointly as a group 202. An individually driveable function field 301 is situated in the centre of the 3×3 grid, said function field having the function of a downlight with focused light distribution. In the case of FIG. 17 (*a*), by way of example, nine individual LED carrier circuit boards 6 are thus assigned to four control channels, wherein it is assumed that only the light intensity for the individuals LED devices 7 is controlled or switched.

In FIG. 17 (*b*), three downlight function fields arranged in a row and each having an elliptic light distribution are provided, which function fields are combined to form a jointly driveable group 206. A middle row is formed by three downlight function fields combined to form a group 205 and having an emission angle of 25 degrees, while in the topmost row in FIG. 17 (*b*) an individually driveable downlight field 302 is arranged between two wallwasher fields combined to form a group 204. In the case of FIG. 17 (*b*), therefore, five individual LED carrier circuit boards 6 are assigned to four control channels, for example.

FIG. 17 (*c*) shows a configuration analogous to FIG. 17 (*b*), in which the fields of the groups 205 and 206 illustrated in FIG. 17 (*b*) are now driveable jointly as a group 207. In this case, all the LED devices 7 of the group 207 are arranged on a common LED carrier circuit board 6, as indicated in FIG. 17 (*c*). An assignment of four individual LED carrier circuit boards 6 to three control channels is thus provided in the configuration in FIG. 17 (*c*).

FIG. 17 (*d*) shows a configuration in which four LED carrier circuit boards 6 are assigned to four control channels. An individually driveable function field 303 acting as a downlight is provided in the top left corner of the 3×3 arrangement in FIG. 17 (*d*), whereas a group 210 of 2×2 jointly driveable downlight fields with an emission angle of 25 degrees is provided proceeding from the bottom right corner of the 3×3 list arrangement. The remaining function fields 13 form wallwasher fields which can radiate upward and toward the left-hand side in FIG. 17 (*d*). The wallwasher fields that radiate upward in FIG. 17 (*d*) are combined in a group 208, while the wallwasher fields that radiate toward the left are combined in a further group 209. Once again, here the LED devices 7 respectively combined in the groups 208, 209 and 210 are arranged respectively on a common carrier circuit board 6.

The arrangement in FIG. 17 (*e*) corresponds to the arrangement in FIG. 17 (*d*) with regard to the manner of operation of the function fields 13, although now the function fields 13 combined in two separate groups 208 and 209 in FIG. 17 (*d*) are combined in a common group 211. The LED devices 7 of the group 211 are nevertheless arranged on two LED carrier circuit boards 6, one for the wallwashers that radiate upward, and one for the wallwashers that radiate to the side toward the left. Four LED carrier circuit boards 6 are thus assigned to three control channels.

In the configuration in FIG. 17 (*f*), two downlight fields are combined to form a jointly driveable group 212, while the LED devices 7 of the remaining function fields 304 to 310 can be driven individually in each case via an assigned channel. Eight control channels are thus used in this case. All the function fields are formed as downlight fields, wherein the function fields of the group 212 each generate an elliptic light distribution, the fields 304 and 305 generate an emission angle of 25 degrees, the fields 306 and 307 generate an emission angle of 35 degrees, the fields 308 and 309 generate an emission angle of 45 degrees, and the field 310 generates a highly focused light distribution.

The configuration illustrated in FIG. 18 corresponds to that in FIG. 17 (*f*), but the function field 310 arranged centrally in FIG. 17 (*f*) is used differently. In FIG. 18, a circuit board with a sensor device 50, said circuit board not being illustrated more specifically, is arranged in the centre of the 3×3 grid.

However, the luminaire 1 does not just make possible the configurations illustrated in FIGS. 17 and 18, but rather affords many further configuration possibilities.

In a method for producing the luminaire 1 in accordance with the exemplary embodiment described above, the procedure as follows is adopted, for example:

A customer, for example a light designer, configures the luminaire 1, for example using software specifically provided for this purpose, and the customer can for example download said software via a data network, for instance the Internet, or operate it directly via the data network.

By way of example, the customer firstly chooses the size of the desired luminaire, for instance a luminaire size which makes possible a 3×3 grid as in FIG. 1. Other sizes of the luminaire can likewise be provided for selection, for example a plurality of function fields in a row, or a grid of function fields in the manner of a 2×2 or 3×2 grid.

The customer then configures the function fields 13, in other words the customer selects the light effect or the light distribution which the function field 13 is intended to produce in each case. If a sensor is intended to be concomitantly incorporated, the customer likewise selects this.

The customer should then specify the desired driving possibilities, for example the extent to which the function fields are intended to be controllable separately or jointly in groups, and whether only the intensity or else the colour of the light is intended to be controllable.

Depending on the abovementioned configuration data specified by the customer in the course of the configuration of the luminaire, a housing component 2, as explained above, is provided and, for example likewise with the aid of the software, the suitable number and type of the LED carrier circuit boards 6 are determined. The latter can then be incorporated into the housing component 2 depending on the configuration data with the appropriate optical components 16 and, if necessary, adapter components 11. The required connections to the central control arrangement 25 are produced by means of flexible cables.

With the aid of the software, a program that is executable by means of the data processing device 62 of the control arrangement 25 can furthermore be provided, generated or configured, once again depending on the configuration data specified by the customer, wherein the program is then transferred to the storage medium 61 of the control arrangement 25. The control of the function fields 13 can be effected or modified by means of the program. By way of example, the same control arrangement 25 can be used for differently configured luminaires 1, the functions of said control arrangement being suitably adapted by the transfer of the program.

In the exemplary embodiment, the LED devices 7 can be connected in parallel in order to be able to drive them separately. The abovementioned program (firmware) can define a maximum control current for each group channel which addresses a control group, in order to ensure that all the light sources can supply the same light intensity in the desired manner.

Figure 19:
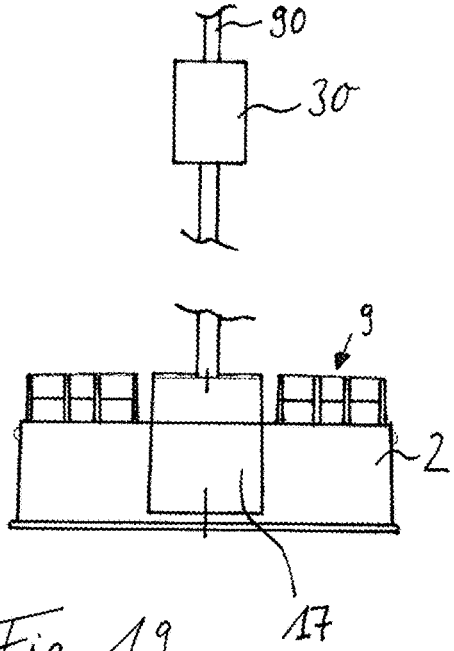
FIG. 19 shows a schematic side view of the housing component and of an external converter and of a connection line, in a simplified variant of the luminaire in accordance with the exemplary embodiment.

In a variant of the exemplary embodiment described above, the driving of the LED devices 17 of the function fields 13 of the luminaire 1 can be implemented in a simplified manner, while the exemplary embodiment described above is highly flexible and very diverse in terms of the possible lighting effects, in a simplified embodiment, for example if simpler lighting effects and lower costs are desired, the luminaire 1 can be constructed without the central control arrangement 25. While the mechanical, optical and thermal concept explained for the exemplary embodiment described above remains unchanged, the supply of the LED devices 7 in the case of the simplified variant is carried out by an external converter 30, which can be arranged for example in the connection line 90. See the schematic illustration in FIG. 19. The converter 30 can be a DALI converter having one or two output channels, as a result of which a more cost-effective driving with reduced complexity for simpler applications is provided.

In the case of such a simplified variant, all the function fields 13 can be formed for example as downlights or as wallwashers, but a combined arrangement of downlights and wallwashers is also present in the case of the above-described simplified variant with driving via the external converter 30.

The power electronic components 29 or arrangements 28 on the LED carrier circuit boards 6 are also omitted in the simplified variant with the external converter 30. In this case, the electric current for supplying the LED devices 7 is supplied directly by the external converter 30, wherein the connection and control unit 17 of the exemplary embodiment described above, in the case of the simplified variant, now forms a connection unit 17 having e.g. only a strain relief means for the connection line 90 and plug connections for connecting the LED carrier circuit boards 6 via flexible cables.

In further variants, proceeding from the above-described exemplary embodiment with a central control arrangement 25, a reduced number of channels could be provided, for example for simpler applications in which nevertheless a plurality of individually controllable light effects are intended to be combined in the luminaire 1. In such a case, the number of control channels could be less than nine, for example four or eight.

Consequently, by means of the flexible driving, the luminaire 1 makes possible the presentation of different lighting effects and different light scenes and also the illumination of a large spatial region in conjunction with a very compact design of the luminaire 1. This is achieved without a mechanical adjustment of individual light sources being provided. A flexible and modular coupling of different numbers of LED carrier circuit boards 6 becomes possible. Furthermore, it becomes possible to arrange different optical components 16, for example different reflectors, at different positions in a uniform, single housing component 2 in a selectable combination, without the housing component 2 having subsequently to be modified. For any size of the luminaire 1, that is to say for a given number and geometric arrangement of function fields 13, only one housing component 2 of a single type has to be manufactured, which advantageously reduces the costs for die-casting tools and the diversity of component parts. The housing component 2 is furthermore optimized with regard to heat dissipation and enables efficient cooling of the LED devices 7. The luminaire 1 has a small height and thus also a comparatively small space requirement. The voltage supply and the driving of the LED devices 7 are accomplished in a space-saving manner.

Although the invention has been fully described above on the basis of preferred exemplary embodiments, it is not restricted thereto, but rather can be modified in diverse ways. Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 102018001653.7, filed Mar. 2, 2018, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A luminaire, comprising:

a housing component having at least one section which projects from a base of the housing component and which is formed with a plurality of surfaces oriented differently relative to the base, wherein an outer shape of the section projecting from the base of the housing component has a shape of a truncated pyramid; and at least one LED carrier circuit board which carries at least one LED device as light source for providing light to be emitted by the luminaire, the LED carrier circuit board being arranged by a rear side thereof at least in sections on one of the plurality of surfaces of the section projecting from the base in such a way that the LED device overlies said one of the surfaces at least partially, wherein the housing component, in the region of the base thereof, has at least one region which is formed as a heatsink for dissipating heat generated by the LED device during operation.

2. The luminaire of claim 1, wherein the housing component is integrally cast.

3. The luminaire of claim 1, wherein the section projecting from the base of the housing component is formed in a domelike fashion.

4. The luminaire of claim 1, wherein a first surface of the surfaces of the section projecting from the base forms a top surface thereof and is oriented preferably substantially parallel to a main extension plane of the base, and wherein second surfaces of the surfaces of the section projecting from the base are formed as surfaces inclined with respect to the main extension plane of the base.

5. The luminaire of claim 4, further comprising at least one adapter component provided with a cutout, in which the section projecting from the base is able to be accommodated at least partially, the LED carrier circuit board being secured on the adapter component in such a way that the rear side of the LED carrier circuit board is arranged on one of the second surfaces of the section projecting from the base at least in sections in such a way that the LED device arranged on said LED carrier circuit board overlies said one of the second surfaces at least partially.

6. The luminaire of claim 1, wherein the housing component has a plurality of the sections projecting from the base, which are formed in an identical way, the luminaire comprising a plurality of function fields, each of the plurality of sections projecting from the base being arranged in one of the plurality of function fields.

7. The luminaire of claim 6, wherein the housing component, in the region of the base thereof, has for each function field a region which is assigned to said function field and which is formed as a heatsink for dissipating heat generated by an LED device arranged in said function field during the operation of said LED device.

8. The luminaire of claim 7, wherein the plurality of regions formed as heatsinks are spaced apart from one another by channels on a rear side of the base facing away from the sections projecting from the base.

9. The luminaire of claim 6, further comprising a plurality of LED devices, each of which is assigned to one of the function fields and is arranged in said one of the function fields.

10. The luminaire of claim 9, further comprising a plurality of LED carrier circuit boards, each of the LED carrier circuit boards carrying one or a plurality of the LED devices.

11. The luminaire of claim 10, wherein the plurality of LED carrier circuit boards have different shapes.

12. The luminaire of claim 6, wherein in at least one first of the function fields a first LED carrier circuit board is arranged by a rear side thereof at least in sections on a first surface of that section projecting from the base which is assigned to the first function field in such a way that an LED device assigned to the first function field and carried by the first LED carrier circuit board overlies the first surface at least partially, wherein a first optical component is arranged in the first function field, and imparts a first emission characteristic to the first function field, wherein in at least one second of the function fields a second LED carrier circuit board is arranged by a rear side thereof at least in sections on a second surface of that section projecting from the base which is assigned to the second function field in such a way that an LED device assigned to the second function field and carried by the second LED carrier circuit board overlies the second surface at least regionally, wherein a second optical component is arranged in the second function field, and imparts a second emission characteristic to the second function field, wherein the first surface and the second surface are oriented in the same way relative to the base, and wherein the first and second emission characteristics are substantially identical or different from one another.

13. The luminaire of claim 12, wherein the first and second emission characteristics are emission characteristics of a downlight or a wallwasher.

14. The luminaire of claim 6, wherein the at least one first of the function fields a first LED carrier circuit board is arranged by a rear side thereof at least in sections on a first surface of that section projecting from the base which is assigned to the first function field in such a way that an LED device assigned to the first function field and carried by the first LED carrier circuit board overlies the first surface at least regionally, wherein a first optical component is arranged in the first function field, and imparts a first emission characteristic to the first function field, wherein in at least one second of the function fields a second LED carrier circuit board is arranged by a rear side thereof at least in sections on a surface of that section projecting from the base which is assigned to the second function field in such a way that an LED device assigned to the second function field and carried by the second LED carrier circuit board overlies the second surface at least partially, wherein a second optical component is arranged in the second function field, and imparts a second emission characteristic to the second function field, and wherein the second surface is oriented differently from the first surface relative to the base.

15. The luminaire of claim 14, wherein the first and second emission characteristics are emission characteristics of a wallwasher.

16. The luminaire of claim 14, wherein the first emission characteristic is an emission characteristic of a downlight and the second emission characteristic is an emission characteristic of a wallwasher.

17. The luminaire of claim 6, further comprising a sensor device arranged in at least one of the function fields.

18. The luminaire of claim 1, further comprising a connection unit or a connection and control unit equipped with a plurality of connecting devices, by means of which the LED carrier circuit board or a plurality of the LED carrier circuit boards are able to be electrically coupled to the connection unit or the connection and control unit, the housing component being formed in a troughlike fashion with a bottom formed by the base, side walls, an inner region and an open side, and the housing component having in a side wall a recess extending into the base and serving for accommodating the connection unit or the connection and control unit, the connection unit or the connection and control unit being formed in a flat fashion and being accommodated with its main extension plane along the side wall in sections in the inner region of the housing component and in the recess.

19. The luminaire of claim 1, further comprising a central control arrangement, which provides a plurality of channels for controlling the LED device or a plurality of the LED devices.

20. The luminaire of claim 19, wherein the control arrangement is configured to drive a plurality of the LED devices individually or in groups.

21. The luminaire of claim 1, further comprising a power electronic component arranged together with the LED device on the LED carrier circuit board.

22. The luminaire of claim 1, further comprising a power electronic arrangement provided on a further circuit board arranged at least partly within the function field assigned to the LED device.

23. The luminaire of claim 1, wherein the luminaire is configured for supplying the LED device or LED devices of the luminaire with electrical energy by means of an external converter.

24. The luminaire of claim 1, wherein the luminaire is switchable or drivable by means of a switching or control signal provided in a wireless or wired manner.

25. The luminaire of claim 1, wherein the LED device is dimmable in an analogue manner.

26. A housing component for the luminaire of claim 1, comprising:

at least one domelike section projecting from a base of the housing component, being connected to the base in a self-supporting manner and being formed with a plurality of surfaces oriented differently relative to the base, an outer shape of the section projecting from the base of the housing component having a shape of a truncated pyramid, the housing component, in the region of the base thereof, having at least one region formed as a heatsink, and the housing component being configured for securing at least one LED carrier circuit board carrying at least one LED device as light source for providing light to be emitted by the luminaire to the housing component in such a way that heat generated by the LED device during operation is able to be dissipated via the section projecting from the base into the region formed as a heatsink.

27. A method for producing the luminaire of claim 1, comprising:

providing a housing component having a predefined number of function fields and having a plurality of sections which project from a base of the housing component, the housing component being formed with a plurality of surfaces oriented differently relative to the base, with each section of the plurality of sections projecting from the base being arranged in different field of the predefined number of function fields, an outer shape of each of the sections projecting from the base of the housing component having a shape of a truncated pyramid; and equipping the housing component with one LED carrier circuit board or a plurality of LED carrier circuit boards or with one assembly or a plurality of assemblies, each comprising at least one LED carrier circuit board and at least one optical component, in such a way that the LED carrier circuit board or a plurality of the LED carrier circuit boards are arranged in each case by a rear side thereof at least in sections on one of the plurality of surfaces of an assigned one of the sections projecting from the base in such a way that an LED device provided on the LED carrier circuit board overlies said one of the surfaces at least partially.

28. The method of claim 27, wherein the housing component is provided and equipped depending on configuration data specified by the customer when ordering the luminaire before the production thereof.

29. The method of claim 28, wherein, depending on the configuration data specified when ordering the luminaire, a program executable by means of a data processing device of a control arrangement of the luminaire is transferred to a storage medium of the control arrangement.

* * * * *